US007559285B2

(12) United States Patent
Smith et al.

(10) Patent No.: US 7,559,285 B2
(45) Date of Patent: Jul. 14, 2009

(54) SPACE EFFICIENT TRANSFORMER STACKING

(75) Inventors: Richard J. Smith, Waukesha, WI (US); James D. Barlow, Hattiesburg, MS (US)

(73) Assignee: Cooper Technologies Company, Houston, TX (US)

( * ) Notice: Subject to any disclaimer, the term of this patent is extended or adjusted under 35 U.S.C. 154(b) by 252 days.

(21) Appl. No.: 10/970,654

(22) Filed: Oct. 22, 2004

(65) Prior Publication Data

US 2005/0193924 A1 Sep. 8, 2005

Related U.S. Application Data

(60) Provisional application No. 60/526,985, filed on Dec. 5, 2003.

(51) Int. Cl.
*B65D 19/38* (2006.01)
*B65D 19/44* (2006.01)

(52) U.S. Cl. ..... 108/33; 108/53.1; 108/55.1; 206/386

(58) Field of Classification Search ..... 108/53.1, 108/55.1, 55.3, 53.5, 33, 91, 51.11, 92, 93, 108/97, 98, 101; 206/319, 335, 701, 722, 206/386, 600, 599; 248/346.02, 346.03; 414/802

See application file for complete search history.

(56) References Cited

U.S. PATENT DOCUMENTS 1,172,259 A * 2/1916 Crist ..... 248/220.1
2,700,520 A * 1/1955 Skubic ..... 108/53.5
2,940,706 A * 6/1960 De Pew ..... 108/53.5
3,289,613 A * 12/1966 Evans ..... 108/53.5
3,962,660 A * 6/1976 Duckett ..... 336/65
4,036,466 A * 7/1977 Van Meter ..... 249/18
4,779,751 A * 10/1988 Munroe ..... 217/69
5,413,224 A * 5/1995 Marron et al. ..... 206/600
5,527,988 A 6/1996 Hernandez et al.
5,593,259 A * 1/1997 Kuo ..... 410/3
5,671,854 A * 9/1997 Thomas ..... 220/1.5
5,772,026 A * 6/1998 Grigsby ..... 206/335
5,918,551 A * 7/1999 Liu ..... 108/55.1
5,938,037 A 8/1999 Essary
6,067,913 A * 5/2000 Bennett ..... 108/53.5

(Continued)

OTHER PUBLICATIONS

Cooper Power Systems, "Distribution Transformers—Single-Phase Pad-Mounted;" Electrical Apparatus 201-20, Jan. 2002, pp. 1-4.

*Primary Examiner*—Janet M Wilkens
*Assistant Examiner*—Timothy M Ayres
(74) *Attorney, Agent, or Firm*—Fish & Richardson P.C.

(57) ABSTRACT

Stacking distribution transformers for shipping and storage includes providing a first pallet on top of which a first distribution transformer is attached and a second pallet on top of which a second distribution transformer is attached. Two side supports are attached to opposite sides of the second distribution transformer such that upper support surfaces of the two side supports extend above an upper surface of the second distribution transformer. The first pallet is placed on the side supports above the second distribution transformer, and the first pallet is secured to the side supports. A center support may be attached to the first pallet and to the second pallet on a side of the second distribution transformer different from the sides of the second distribution transformer to which the side supports support are attached.

22 Claims, 14 Drawing Sheets

U.S. PATENT DOCUMENTS 6,371,299 B1 4/2002 Essary
D463,894 S 10/2002 Ghafourian et al.
6,851,555 B1 * 2/2005 Ghafourian et al. ..... 206/386
7,044,065 B2 * 5/2006 Arai et al. ..... 108/53.1
2004/0188307 A1 * 9/2004 Beck ..... 206/503

* cited by examiner

SPACE EFFICIENT TRANSFORMER STACKING

CROSS REFERENCE TO RELATED APPLICATIONS

This application claims the benefit of U.S. Provisional Application No. 60/526,985, filed Dec. 5, 2003, and titled "Palletizing Assembly and Method," which is incorporated by reference in its entirety.

TECHNICAL FIELD

This document relates to space efficient stacking of transformers, such as distribution transformers, for shipping and storage.

BACKGROUND

The primary method of shipping distribution transformers is by truck. As the transformers are loaded onto the deck of the truck, it is common to run out of deck space on the truck before using the maximum weight capacity of the truck. A more spatially and financially efficient method of shipping involves placing two or more distribution transformers to be shipped in the footprint, or deck space, occupied by one distribution transformer. One existing technique for doing so uses enclosed van carriers to create a second deck above the distribution transformers shipped on the floor of the truck. When storing the shipped distribution transformers that are not stacked, floor space of a storage location may be exhausted before the full storage capacity of the storage location is used.

SUMMARY

In one general aspect, a system for stacking distribution transformers for shipping and storage includes a first pallet to which a first distribution transformer is attached and a second pallet to which a second distribution transformer is attached. Two side supports on opposite sides of the second distribution transformer support the first pallet above the second pallet. Each side support is attached to the second distribution transformer and the first pallet.

Implementations may include one or more of the following features. For example, each side support may be attached to the second distribution transformer at lift bolt provisions of the second distribution transformer.

Each side support may include an upper yoke in which a side stringer of the first pallet fits. The upper yoke may be attached to the side stringer with a fastener. The upper yoke may include a slot around the fastener that allows the side stringer to be removed from the upper yoke without fully removing the fastener. Each side support also may include a lower yoke in which a side stringer of the second pallet fits.

Each side support may include an upper bracket that fits around a side stringer of the first pallet, or a lower bracket that fits around a side stringer of the second pallet. The bracket may be held to the side stringer with a cleat. The cleat may be attached to the side stringer through a spacer that creates a space between the side stringer and the cleat for the upper bracket.

Two additional side supports may be placed on the same sides of the second distribution transformer as the two side supports.

Each side support may include a main shaft that extends between the first pallet and the second pallet and is substantially parallel to a side of the second distribution transformer closest to the side support.

A center support may attach the first pallet to the second pallet on a side of the second distribution transformer different from the sides of the second distribution transformer to which the side supports support are attached. The center support may include an upper yoke in which a center stringer of the first pallet fits. The upper yoke may be attached to the center stringer with a fastener. The upper yoke includes a slot around the fastener that allows the center stringer to be removed from the upper yoke without fully removing the fastener.

The center support may include a lower bracket that fits around a center stringer of the second pallet. The lower bracket may be held to the center stringer with a cleat that fits around the center stringer and the lower bracket. The cleat may be attached to the center stringer with a fastener that is driven through a hole in the cleat into a hole in the center stringer.

The center support may include an upper bracket that fits around a center stringer of the first pallet. The center support also may include a main shaft that extends between the first pallet and the second pallet and is substantially parallel to a side of the second distribution transformer closest to the center support.

A strap may be wrapped around at least one component of at least of one of the first pallet, the second pallet, the first distribution transformer, and the second distribution transformer.

A first bracing bar may be attached to the first pallet and the second pallet. The first bracing bar may be attached to ends of side stringers of the first pallet and the second pallet. A second bracing bar attached to the first pallet and the second pallet may intersect the first bracing bar. The first and second bracing bars may be attached to one another at a point at which the first and second bracing bars intersect.

A third bracing bar attached to the first pallet to the second pallet may intersect the first and second bracing bars at a point at which the first and second bracing bars intersect. The third bracing bar may be attached to ends of center stringers of the first pallet and the second pallet. The first, second, and third bracing bars may be attached to one another at a point at which the first, second, and third bracing bars intersect.

In another general aspect, supporting a first distribution transformer above a second distribution transformer includes providing a first pallet on top of which a first distribution transformer is attached and a second pallet on top of which a second distribution transformer is attached. Two side supports are attached to opposite sides of the second distribution transformer such that upper support surfaces of the two side supports extend above an upper surface of the second distribution transformer. The first pallet is placed on the side supports above the second distribution transformer, and the first pallet is secured to the side supports.

Implementations may include one or more of the following features. For example, attaching side supports to opposite sides of the second distribution transformer may include attaching main shafts of the side supports to the second distribution transformer at lift bolt provisions of the second distribution transformer with bolts driven through holes in the side supports.

Lower brackets of the side supports may be placed around side stringers of the second pallet. Placing the lower brackets of the side supports around side stringers of the second pallet may include placing the lower brackets around a deck of the second pallet and the side stringers of the second pallet. Cleats may be secured around the lower brackets to the side stringers of the second pallet by driving fasteners through the cleats and through spacers that create space between the side stringers and the cleats for the lower brackets into the side stringers.

Lower yokes of the side supports may be placed around side stringers of the second pallet.

Securing the first pallet to the side supports may include securing cleats around the upper support surfaces to the side stringers of the second pallet. Securing the cleats to the side stringers may include driving fasteners through the cleats and through spacers that create space between the side stringers and the cleats for the upper support surfaces into the side stringers.

Securing the first pallet to the side supports may include installing fasteners into the side stringers through slots in the upper support surfaces that allow the side stringers to be disengaged from the upper support surfaces without fully removing the fasteners.

A center support may be attached to the first pallet and to the second pallet. A lower support surface of the center support may be secured to a center stringer of the second pallet. Securing the center stringer of the second pallet to the lower support of the center support may include securing a cleat around the lower support and the center stringer. Securing the cleat around the lower support and the center stringer may include installing a fastener through a hole in the cleat into a hole in the center stringer.

An upper support surface of the center support may be secured to a center stringer of the first pallet. Securing the upper support surface of the center support to the center stringer of the first pallet may include installing a fastener into the center stringer through a slot in the upper support surface that allows the center stringer to be disengaged from the upper support surface without fully removing the fastener.

A strap may be tightened around at least one component of at least of one of the first pallet, the second pallet, the first distribution transformer, and the second distribution transformer.

A first bracing bar may be attached to the first pallet and the second pallet. Attaching the first bracing bar to the first pallet and the second pallet may include attaching the first bracing bar to ends of side stringers of the first pallet and the second pallet. A second bracing bar may be attached to the first pallet and the second pallet such that the second bracing bar intersects the first bracing bar. The first and second bracing bars may be attached to one another at a point at which the first and second bracing bars intersect.

A third bracing bar may be attached to the first pallet and the second pallet such that the third bracing bar intersects the first and second bracing bars at a point at which the first and second bracing bars intersect. Attaching a third bracing bar to the first pallet and the second pallet may include attaching the third bracing bar to ends of center stringers of the first pallet and the second pallet. The first, second, and third bracing bars may be attached to one another at a point at which the first, second, and third bracing bars intersect.

Two additional side supports may be attached to opposite sides of the second distribution transformer such that upper support surfaces of the two additional side supports extend above an upper surface of the second distribution transformer. The first pallet may be placed on the two additional side supports above the second distribution transformer, and the first pallet may be secured to the two additional side supports.

These general and specific aspects may be implemented using a system, a method, or any combination of systems and methods.

Other features will be apparent from the description and drawings, and from the claims.

DESCRIPTION OF DRAWINGS

Like reference symbols in the various drawings indicate like elements.

DETAILED DESCRIPTION

A palletizing system is used to stack multiple distribution transformers in the footprint of a single distribution transformer. The palletizing system stacks a first distribution transformer on first pallet above a second distribution transformer on a second pallet. The palletizing system includes two or more side supports that support the first distribution transformer above the second distribution transformer. The side supports connect to the second distribution transformer and the first pallet, and optionally to the second pallet. An optional center support that provides additional support for the first distribution transformer connects to the first and second pallets. The side and center supports may be attached to the pallets and to the second distribution transformer using cleats, clevis pins, bolts, lag screws, or other attachment hardware. The palletizing system also may include bracing bars and straps for further strength and stabilization.

Stacking the first distribution transformer above the second distribution transformer enables more space efficient shipping and storage of the first and second distribution transformers. Stacking distribution transformers reduces the likelihood of running out of deck space on a truck used to ship the distribution transformers before using the maximum weight capacity of the truck, because less deck space is used per distribution transformer. Stacking distribution transformers with the palletizing system also eliminates the need for a specialized truck for shipping the multiple distribution transformers in the footprint of a single distribution transformer, which reduces the shipping costs of the distribution transformers. Furthermore, vertically stacked distribution transformers may be more efficiently stored because less floor space is used per distribution transformer. In addition, stacking distribution transformers enables a forklift to move two distribution transformers at once. Some forklifts with sufficient size and power and with sufficiently long forks may lift four stacked distribution transformers at once.

Figure 1A:
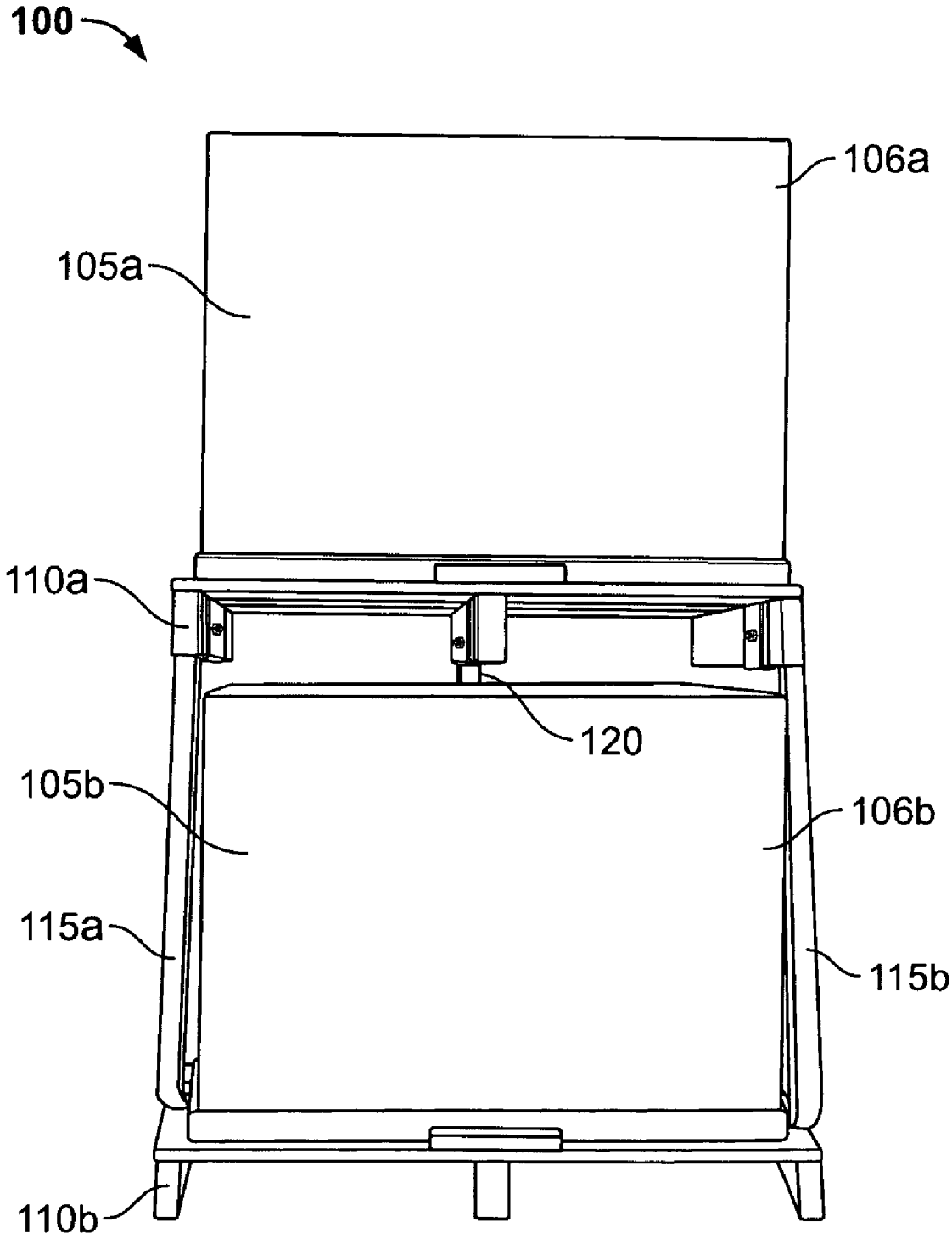
FIGS. 1A and 1B are illustrations of a palletizing system for stacking distribution transformers.
Figure 1B:
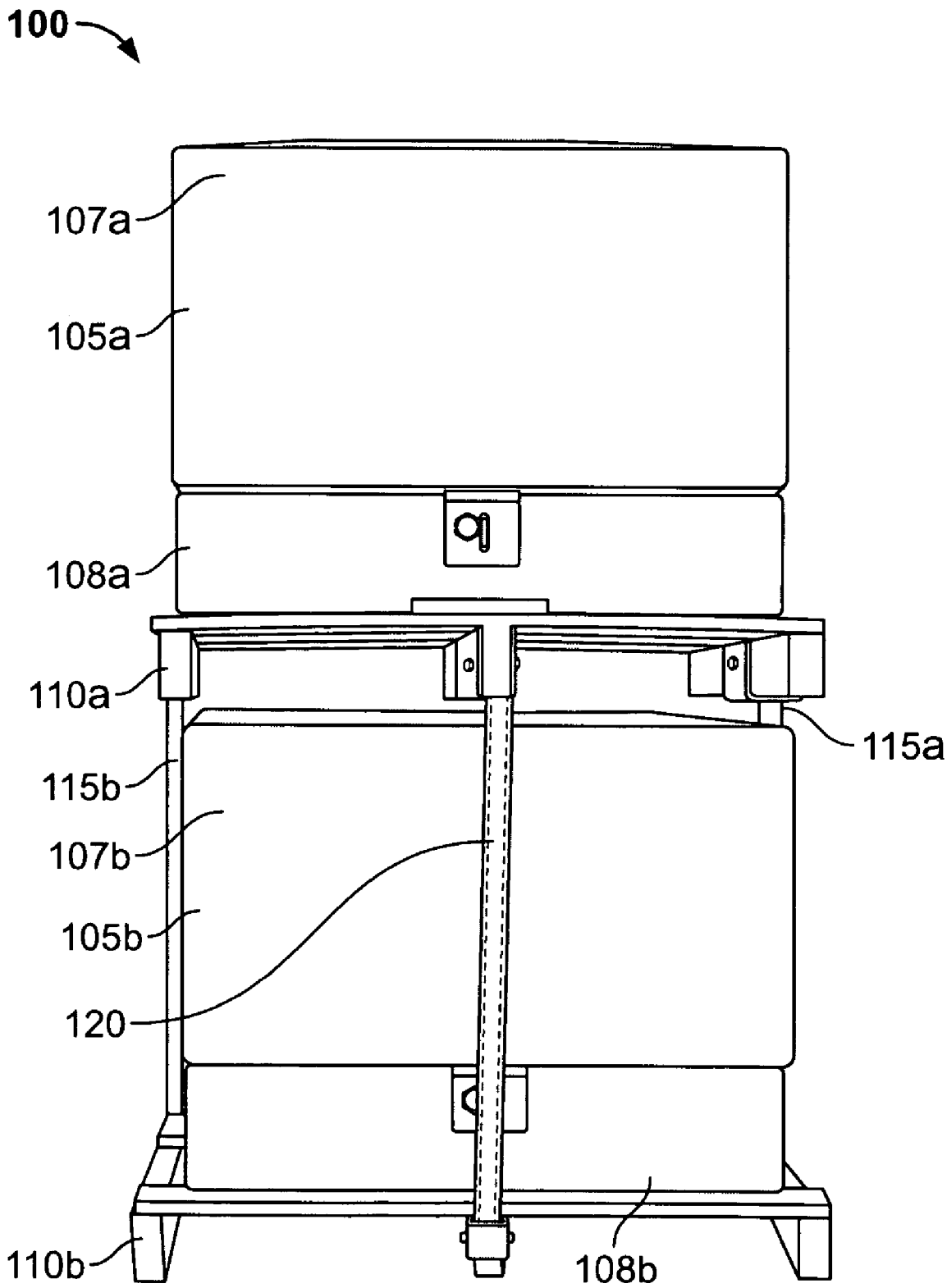

Referring to FIGS. 1A and 1B, one implementation of a palletizing system 100 is used to stack a first distribution transformer 105*a* above a second distribution transformer 105*b*. The distribution transformers 105*a* and 105*b* are conventional distribution transformers typically used in residential applications. The distribution transformers 105*a* and 105*b* include tanks 106*a* and 106*b*, doors 107*a* and 107*b*, and sills 108*a* and 108*b*, respectively. The first distribution transformer 105*a* is secured to a first pallet 110*a*, and the second distribution transformer 105*b* is secured to a second pallet 110*b*. Side supports 115*a* and 115*b* support the first distribution transformer 105*a* and the first pallet 110*a* above the second distribution transformer 105*b* and the second pallet 110*b*. A center support 120 also may be used to provide additional support to the first distribution transformer 105*a* and the first pallet 110*a*.

The tanks 106*a* and 106*b* are sealed boxes containing electrical components of the distribution transformers 105*a* and 105*b*. More particularly, each of the tanks 106*a* and 106*b* houses a transformer electrical core, a coil assembly, and an insulating fluid. Connections are made to the electrical cores and the coil assemblies through holes in the fronts of the tanks 106*a* and 106*b*, and appropriate accessories are installed on the outsides of the tanks 106*a* and 106*b*. After the electrical cores and the coil assemblies have been placed inside the tanks 106*a* and 106*b*, the tanks 106*a* and 106*b* are filled with the insulating fluid, which may be, for example, a mineral oil or a vegetable-based oil. The tanks 106*a* and 106*b* then are sealed.

The doors 107*a* and 107*b* include upper pieces that are hinged to the tanks 106*a* and 106*b* and that allow the doors 107*a* and 107*b* to open and close in a clamshell fashion. The doors 107*a* and 107*b* provide access to the accessories installed on the outsides of the tanks 106*a* and 106*b*, respectively, when open. The doors 107*a* and 107*b* protect against contact with the accessories when closed, secured, and locked.

The sills 108*a* and 108*b* provide an anchoring flange for securing the distribution transformers 105*a* and 105*b* to pads on which the distribution transformers 105*a* and 105*b* sit. In addition, the sills 108*a* and 108*b* provide an anchor for securing and locking the doors 107*a* and 107*b* when closed.

The tanks 106*a* and 106*b* are located on one side of the distribution transformers 105*a* and 105*b*, and the doors 107*a* and 107*b* and the sills 108*a* and 108*b* are located on an opposite side of the distribution transformers 105*a* and 105*b*. Areas enclosed by the doors 107*a* and 107*b* are relatively hollow, while the tanks 106*a* and 106*b* are filled with the insulating fluid, such that the majority of the weight of the distribution transformers 105*a* and 105*b* is centered in the tanks. As a result, the center of gravity of each of the distribution transformers 105*a* and 105*b* is located in the corresponding tank 106*a* or 106*b* and is not co-located with the geometric center of the distribution transformers 105*a* and 105*b*.

Each of the distribution transformers 105*a* and 105*b* includes an upper side, a lower side, a right side, a left side, a front side, and a back side. The tanks of distribution transformers 105*a* and 105*b* span the entire back sides and part of the right, left, upper, and lower sides of the distribution transformers 105*a* and 105*b*. A distribution transformer 105*a* or 105*b* includes one or two lift bolt provisions on the surface of the tanks on the left and right sides, depending on the weights of the distribution transformer. For example, the distribution transformers 105*a* and 105*b* may be so heavy as to necessitate four lift bolt provisions to maintain a lifting strength safety factor of five, as specified by the American National Standards Institute (ANSI). The lift bolt provisions are large hex screws with washers that may be used to lift the distribution transformers 105*a* and 105*b*. In implementations where each of the left and right side includes one lift bolt provision, the lift bolt provisions are staggered on the left and right sides. More particularly, the lift bolt provision on one side is located approximately four inches from the front of the tank, and the lift bolt provision on an opposite side is located approximately four inches from the rear of the tank. In implementations where each of the left and right sides includes two lift bolt provisions, the lift bolt provisions are located approximately four inches in from the front and back of the tanks. In other words, a distribution transformer includes a front and a back lift bolt provision on each of the left and right sides in such implementations.

The distribution transformers 105*a* and 105*b* are secured to pallets 110*a* and 110*b*, respectively, that are typically made out of wood. The distribution transformers 105*a* and 105*b* may be attached to the pallets 110*a* and 110*b* using one or more lag screws or other attachment hardware. In one implementation, two lag screws are used to attach the pallets 110*a* and 110*b* to the distribution transformers 105*a* and 105*b*, respectively. The pallets 110*a* and 110*b* facilitate lifting and moving the distribution transformers 105*a* and 105*b* with, for example, forklifts.

In general, a pallet includes multiple planks oriented in a parallel manner that collectively form a deck of the pallet. Each pallet also includes side and center stringers that connect the flat planks of the deck. Nails, screws, or other attachment hardware may be used to attach the planks to the stringers. The stringers are underneath and perpendicular to the planks such that each stringer contacts each plank, and such that the stringers are parallel to one another. The stringers are oriented relative to the planks such that the overall height of the pallet is the thickness of the planks of the deck and the width of the stringers. The pallets 110*a* and 110*b* typically include two side stringers that attach to the planks at opposite ends of the planks and one center stringer that attaches to the planks at the center of the planks. The distribution transformers 105*a* and 105*b* are oriented relative to the pallets 110*a* and 110*b* such that the back sides of the distribution transformers 105*a* and 105*b* are located on sides of the pallets 105*a* and 105*b* at which the ends of the stringers are located.

The side supports 115*a* and 115*b* support the first distribution transformer 105*a* on the first pallet 110*a* above the second distribution transformer 105*b*. The side supports 115*a* and 115*b* are located on opposite sides of the second distribution transformer 105*b*. The side supports 115*a* and 115*b* are identical, and the following description of the side support 115*a* applies to the side support 1115*b*.

Figure 2:
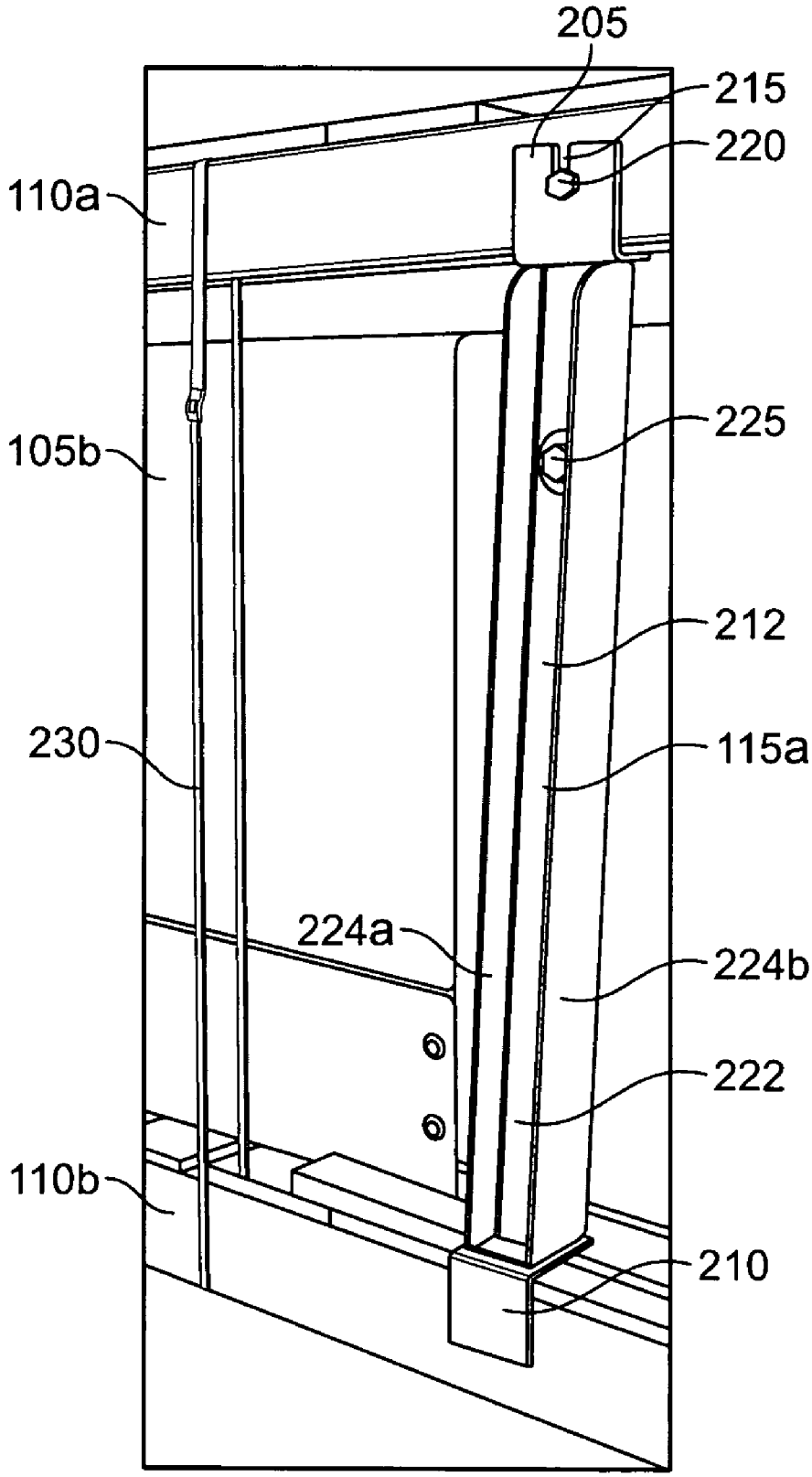
FIG. 2 is an illustration of a side support used in the palletizing system of FIGS. 1A and 1B.

Referring also to FIG. 2, the side support 115*a* also includes an upper yoke 205, a lower yoke 210, and a main shaft 212 between the upper and lower yokes. The upper yoke 205 includes a slot 215 into which a lag screw 220 fits. The main shaft 212 includes a first vertical piece 222 and two additional vertical pieces 224*a* and 224*b*. The side support 115*a* is attached to the second distribution transformer 105*b* with a bolt 225, which may be used with a washer. A strap 230 stabilizes the first distribution transformer 105*a* above the second distribution transformer 105*b*.

The upper yoke 205 is a rectangular channel into which a side stringer of the first pallet 110*a* may be placed. The upper yoke 205 is sufficiently wide to enable the side stringer to be easily placed within the rectangular channel, and to accept reasonable variations in the overall width of the first pallet 110*a* and in the width of the side stringer. The upper yoke 205 includes a slot 215 that facilitates removing the side stringer of the first pallet 10*a* from the upper yoke 205. A lag screw 220 is partially driven into the side stringer through the slot 215. When the first distribution transformer 105*a* and the first pallet 110*a* are to be lowered from above the second distribution transformer 105*b*, the first pallet 110*a* is raised such that the lag screw 220 exits the slot 215 and frees the first pallet 110*a* from the upper yoke 205.

The lower yoke 210 also is a rectangular channel that is sufficiently wide to easily fit around a side stringer of the second pallet 110*b*. The lower yoke 210 also may be secured to the side stringer of the second pallet 110*b* using a lag screw driven into the side stringer and a slot in the lower yoke 210. Alternatively or additionally, the weight of the first distribution transformer 105*a* and the first pallet 110*a* may be sufficient to secure the lower yoke 210 to the side stringer without any attachment hardware.

The main shaft 212 of the side support 115*a* extends between the upper yoke 205 and the lower yoke 210. The main shaft 212 includes the first vertical piece 222 that fits flat against the second distribution transformer 105*b*. The main shaft 212 also includes the two additional vertical pieces 224*a* and 224*b* that are perpendicular to the first vertical piece 222 and parallel to one another and that strengthen the side support 115*a*. The vertical pieces 222, 224*a*, and 224*b* of the main shaft 212 connect to both the upper yoke 205 and the lower yoke 210. Two sides of the first vertical piece 222 connect to a side of each of the two additional vertical pieces 224*a* and 224*b* such that the main shaft 212 generally forms a rectangular channel.

The first vertical piece 222 of the main shaft 212 may include a hole through which a bolt 225 may be driven to attach the side support 115*a* to the second distribution transformer 105*b* at lift bolt provisions of the second distribution transformer 105*b*. In implementations where the sides of the distribution transformer 105*b* to which the side supports 115*a* and 115*b* are attached include two lift bolt provisions, the side supports 115*a* and 115*b* may be connected to the two front lift bolt provisions, the two back lift bolt provisions, or one front lift bolt provision and one back lift bolt provision on opposite sides of the second distribution transformer 105*b*.

A strap 230 may be used to stabilize the first distribution transformer 105*a* above the second distribution transformer 105*b*. The strap 230 is a tension-only member used to secure the front of the first pallet 110*a* on the center support 120. The strap 230 extends around a side stringer of the first pallet 110*a* and a side stringer of the second pallet 110*b* directly below the side stringer of the first pallet 110*a*. In one implementation, the strap 230 is steel banding. The strap 230 also may be plastic banding, a metal strip, or a metal strut. The strap 230 restrains the first distribution transformer 105*a* from pivoting on the side supports 115*a* and 115*b*. Such pivoting may be caused by horizontal acceleration associated with lifting and moving the distribution transformers 105*a* and 105*b* after the distribution transformers 105*a* and 105*b* have been stacked. In one implementation, a single strap sufficiently restrains the first distribution transformer 105*a* from pivoting due to the horizontal acceleration. In other implementations, multiple straps may be used to restrain the first distribution transformer 105*a*. When disassembling the palletizing system 100, the strap 230 may be cut to free the first pallet 110*a* from the center support 120. Once the strap 230 is cut, no further tools are required to lower the first distribution transformer 105*a* and to disassemble the palletizing system 100.

Referring again to FIGS. 1A and 1B, the palletizing system 100 optionally may include a center support 120 to provide additional support for the first distribution transformer 105*a* above the second distribution transformer 105*b*. The center support 120 is located near a front side of the second distribution transformer 105*b* that is not adjacent to the tank of the second distribution transformer 105*b*. The center support 120 is used when the side supports 115*a* and 115*b*, and the upper and lower yokes or brackets thereof, are not wide enough to provide sufficient stability to the palletizing system. The center support 120 provides a broader stance for the first distribution transformer 105*a*, which leads to greater stability of the palletizing system 100. The center support 120 also provides additional structural support to the palletizing system 100 to oppose a downward force, such as a force of a tightened strap used to secure the palletizing system to, for example, the deck of a truck, that is applied to the palletizing system 100.

Referring also to FIGS. 3A, 3B, 3C, and 3D, the center support 120 includes an upper yoke 305, a lower bracket 310, and a main shaft 312 between the upper yoke 305 and the lower bracket 310. The upper yoke 305 includes a slot 315 into which a lag screw 320 that has been driven into the first pallet 110*a* fits. Similarly, the lower bracket 310 may include slots 322 and 324 into which lag screws or other fasteners that have been driven into the second pallet 110*b* fit. Alternatively, a cleat 325, a clevis pin 330, and a holding pin 335 may secure the lower bracket 310 to the second pallet 110*b*.

The upper yoke 305 is similar to the upper yoke 205 of FIG. 2, except the upper yoke 305 fits around a center stringer of the first pallet 110*a*. The upper yoke 305 includes a slot 315 that facilitates removing the center stringer of the first pallet 110*a* from the upper yoke 305. A lag screw 320 is partially driven into the center stringer through the slot 315. When the first distribution transformer 105*a* and the first pallet 110*a* are to be lowered from above the second distribution transformer 105*b*, the first pallet 110*a* is raised such that the lag screw 320 exits the slot 315 and frees the first pallet 110*a* from the upper yoke 305.

The lower bracket 310 is an "L"-shaped piece that extends around the deck of the second pallet 110*b* and the front of the center stringer of the second pallet 10*b*. In one implementation, lag screws or other fasteners are driven through the portion of the lower bracket 310 in front of the center stringer and also through the end of the center stringer itself to secure the lower bracket 310 to the second pallet 110*b*. More particularly, the lower bracket 310 may include one or more slots, such as an upper slot 322 and a lower slot 324, through which the lag screws may be driven into the center stringer. The slots 322 and 324 enable the lower bracket 310 to be secured to the second pallet 110*b* such that the lower bracket 310 does not rotate in a plane parallel to the end of the center stringer and such that the lower bracket 310 does not disengage from the second pallet 110*b* while raising the first distribution transformer 105*a* to disassemble the palletizing system 100. The slots 322 and 324 also enable the center post 120 to be detached from the second pallet 110*b* without tools as the palletizing system 100 is disassembled, provided the lag screws are not fully tightened.

In another implementation, a cleat 325 is used to secure the lower bracket 310 to the center stringer. The cleat 325 is a "U"-shaped piece that extends around the front and two sides of the center stringer and fits around the part of the lower bracket 310 that is in front of the center stringer. A clevis pin 330 is driven through holes in the faces of the cleat 325 on the two sides of the center stringer and in the center stringer itself. A holding pin 335 is placed through a hole in the end of the clevis pin 330 to prevent the clevis pin from exiting the holes through the faces of the cleat 325 and the center stringer. The cleat 325 may include multiple sets of holes into which the clevis pin 330 may be inserted to account for possible defects or variations in the center stringer. Alternatively, lag screws or bolts may be driven through the holes in the cleat 325 to secure the cleat 325 to the center stringer.

In some implementations, the portions of the lower bracket 310 and the cleat 325 that are in front of the center stringer may be connected or formed into a single piece. In such implementations, the cleat 325 may be "U"-shaped and extend around the front and two sides of the center stringer, or the cleat 325 may be "L"-shaped and extend around the front and one side of the center stringer. Pins, lag screws, bolts, or other attachment hardware may be driven through holes in the cleat 325 to secure the cleat 325 to the center stringer when the cleat 325 and the center stringer are attached. Alternatively, the attachment hardware may be partially inserted into the center stringer, inserted into slots in the cleat 325, and tightened within the slots, in the same manner as what is done with the upper yoke 305.

The cleat 325, the clevis pin 330, and the holding pin 335 collectively prevent the lower bracket 310 from moving horizontally away from the second pallet 110*b* and the second distribution transformer 105*b*. The weight of the first distribution transformer 105*a* and the first pallet 110*a* above the center support 120 prevents the lower bracket 310 from exiting the space between the cleat 325 and the center stringer. Pivoting caused by horizontal acceleration of the distribution transformers 105*a* and 105*b* when stacked may cause the lower bracket 310 to move out of the space, but the strap 230 of FIG. 2 restrains the pivoting. When the palletizing assembly is disassembled, the center support 120 may be lifted out of the space between the cleat 325 and the center stringer, unless the cleat 325 tightly holds the center support 120 to the center stringer, in which case the attachment hardware that holds the cleat 325 to the center stringer may need to be loosened prior to removal of the center support 120.

The main shaft 312 of the center support 120 extends between and connects to the upper yoke 305 and the lower bracket 310. The main shaft 312 may be a solid or hollow piece of metal with a square, rectangular, or round cross section. Alternatively, the main shaft 312 may be "L"-shaped. In some implementations, the center support 120 may be made of wood. In such implementations, the main shaft 312 of the center support 120 is a post that includes dowels extending from opposite ends of the post. The dowel at the top of the center support 120 engages a hole drilled into the bottom of the center stringer of the first pallet 10*a*, and the dowel at the bottom of the center support 120 engages a hole drilled into the top of the deck and the center stringer of the lower pallet 10*b*.

Figure 4:
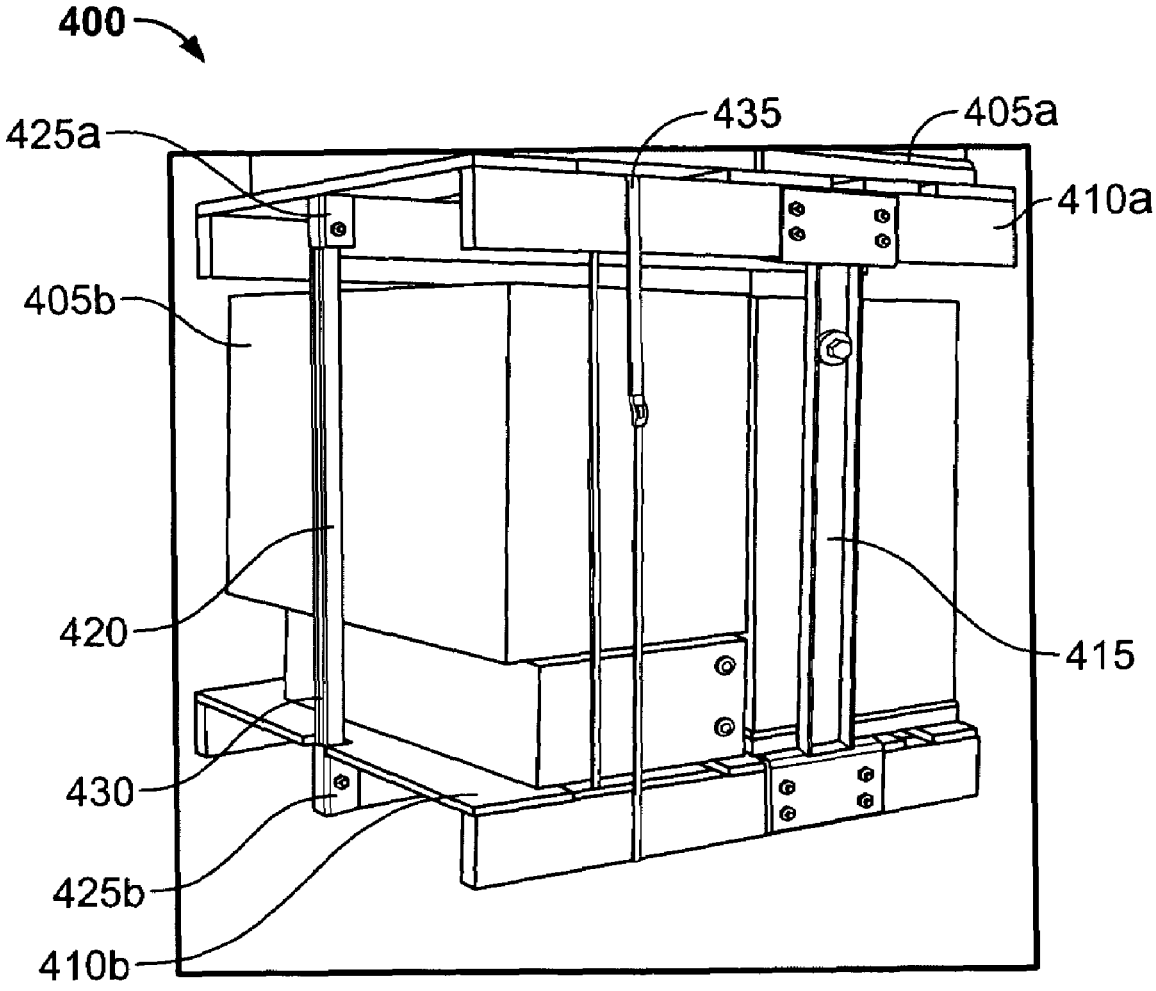
FIG. 4 is an illustration of another palletizing system.

Referring to FIG. 4, another palletizing system 400 is used to stack a first distribution transformer 405*a* above a second distribution transformer 405*b*. The distribution transformers 405*a* and 405*b* are mounted on pallets 410*a* and 410*b*, respectively. A side support 415 and a center support 420 support the first distribution transformer 405*a* above the second distribution transformer 405*b*. The center support 420 includes brackets 425*a* and 425*b* and a main shaft 430 between the brackets 425*a* and 425*b*. A strap 435 that is similar to the strap 230 of FIG. 2 secures and stabilizes the palletizing system 400.

Figure 5:
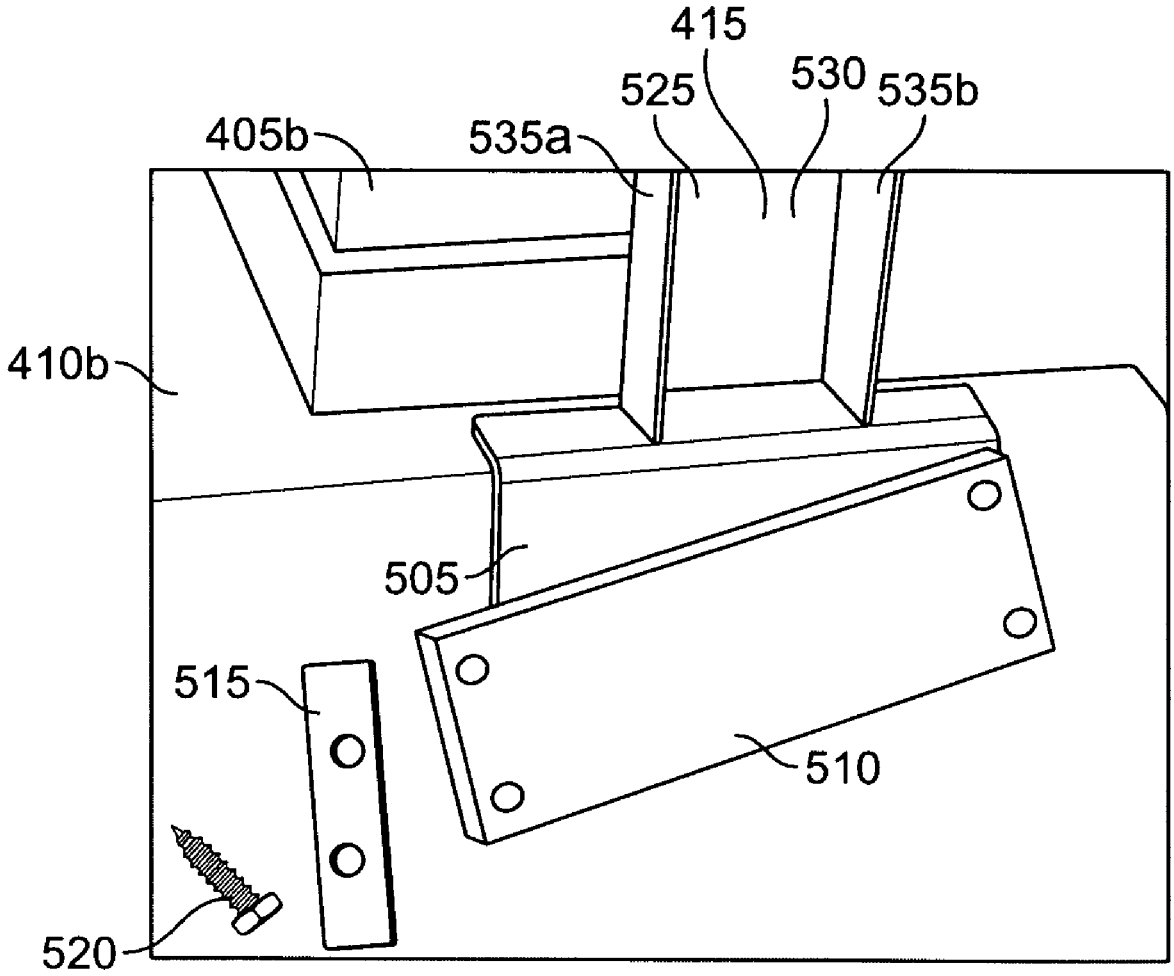
FIG. 5 is an illustration of a lower bracket of a side support used in the palletizing system of FIG. 4.

The palletizing system 400 includes a side support 415 on two opposite sides of the second distribution transformer 405*b*, but only one side support 415 is visible in FIG. 4. The side support 415 is similar to the side supports 115*a* and 115*b* of FIG. 1. Referring also to FIG. 5, each end of the side support 415 includes an "L"-shaped bracket 505 that is secured to one of the pallets 410*a* or 410*b* with a cleat 510, one or more spacers 515, and at least one lag screw 520. The bracket 505 attaches to one end of a main shaft 525 of the side support 415. The main shaft 525 includes a first vertical piece 530 and two additional vertical pieces 535*a* and 535*b*.

FIG. 5 illustrates the lower end of the side support 415, which is analogous to the upper end of the side support 415. On the lower end of the side support 415, the bracket 505 extends around the deck of the second pallet 410*b* and the outer side of one of the side stringers of the second pallet 410*b*, while on the upper end of the side support 415, the bracket 505 extends around the bottom and the outer side of one of the side stringers of the first pallet 410*a*. In one implementation, lag screws are driven through the bracket 505 and a corresponding side stringer to secure the bracket 505 to the corresponding side stringer.

In another implementation, a cleat 510, one or more spacers 515, and at least one lag screw 520 are used to secure the bracket 505 to a corresponding side stringer. The cleat 510 is a metal plate that is attached to the side stringer to hold the bracket 505 to the second pallet 410*b*. The bracket 505 fits between the cleat 510 and the side stringer. The cleat includes several holes through which the lag screw 520 may be driven to attach the cleat 510 to the side stringer.

The spacer 515 may be inserted between the cleat 510 and the side stringer to create a space into which the bracket 505 may fit. The spacer 515 has approximately the same thickness as the bracket 505. In one implementation, the spacer 515, or some other feature to create a space for the bracket 505, is included in the cleat 510. The spacer 515 also may include one or more holes that align with the holes in the cleat 510 such that at least one end of the lag screw 520 may be driven through the spacer 515 as well as the cleat 510 to secure the cleat 510 and the spacer 515 to the side stringer. When the palletizing system 400 is disassembled, the lag screws through the cleat 510 and the spacer 515 do not need to be loosened, or only need to be partially loosened, to enable the bracket 505 to be removed from the space between the cleat 510 and the side stringer.

The main shaft 525 of the side support 415 extends between the upper and lower brackets of the side support 415. The main shaft 525 is similar to the main shaft 212 of FIG. 2. The main shaft 525 of the side support 415 includes a first vertical piece 530 that fits flat against the second distribution transformer 405*b*. The main shaft 525 also includes two additional vertical pieces 535*a* and 535*b* that strengthen the side support 415. The additional vertical pieces 535*a* and 535*b* are perpendicular to the first vertical piece 530 and parallel to one another such that the vertical pieces 530, 535*a*, and 535*b* of the main shaft 525 collectively form a rectangular channel. The vertical pieces 530, 535*a*, and 535*b* of the main shaft 525 connect to both the upper and lower brackets. The first vertical piece 530 of the main shaft 525 may include a hole through which a bolt may be driven to attach the side support 415 to the second distribution transformer 405*b* at lift bolt provisions of the second distribution transformer 405*b*. In implementations in which the distribution transformer includes two lift bolt provisions on two opposite sides, two side supports 415 may be attached to the opposite sides at corresponding or opposite lift bolt provisions. More particularly, the two side supports 415 may be attached to lift bolt provisions that are at the same or different distances from the rear of the tank of the second distribution transformer 405*b*.

Referring again to FIG. 4, the palletizing system 400 optionally may include a center support 420 to provide additional support for the first distribution transformer 405*a* above the second distribution transformer 405*b* by providing a broader stance for the first distribution transformer 405*a*. The center support 420 is located near a front side of the second distribution transformer 405*b*. The center support 420 includes an upper bracket 425*a*, a lower bracket 425*b*, and a main shaft 430 between the upper bracket 425*a* and the lower bracket 425*b*. Like the main shaft 312 of the center support 120, the main shaft 430 of the center support 420 is a solid or hollow piece of metal that connects the upper bracket 425*a* and the lower bracket 425*b*. The main shaft 430 may have a square, rectangular, or round cross section, or the main shaft 430 may be "L"-shaped.

Figure 3A:
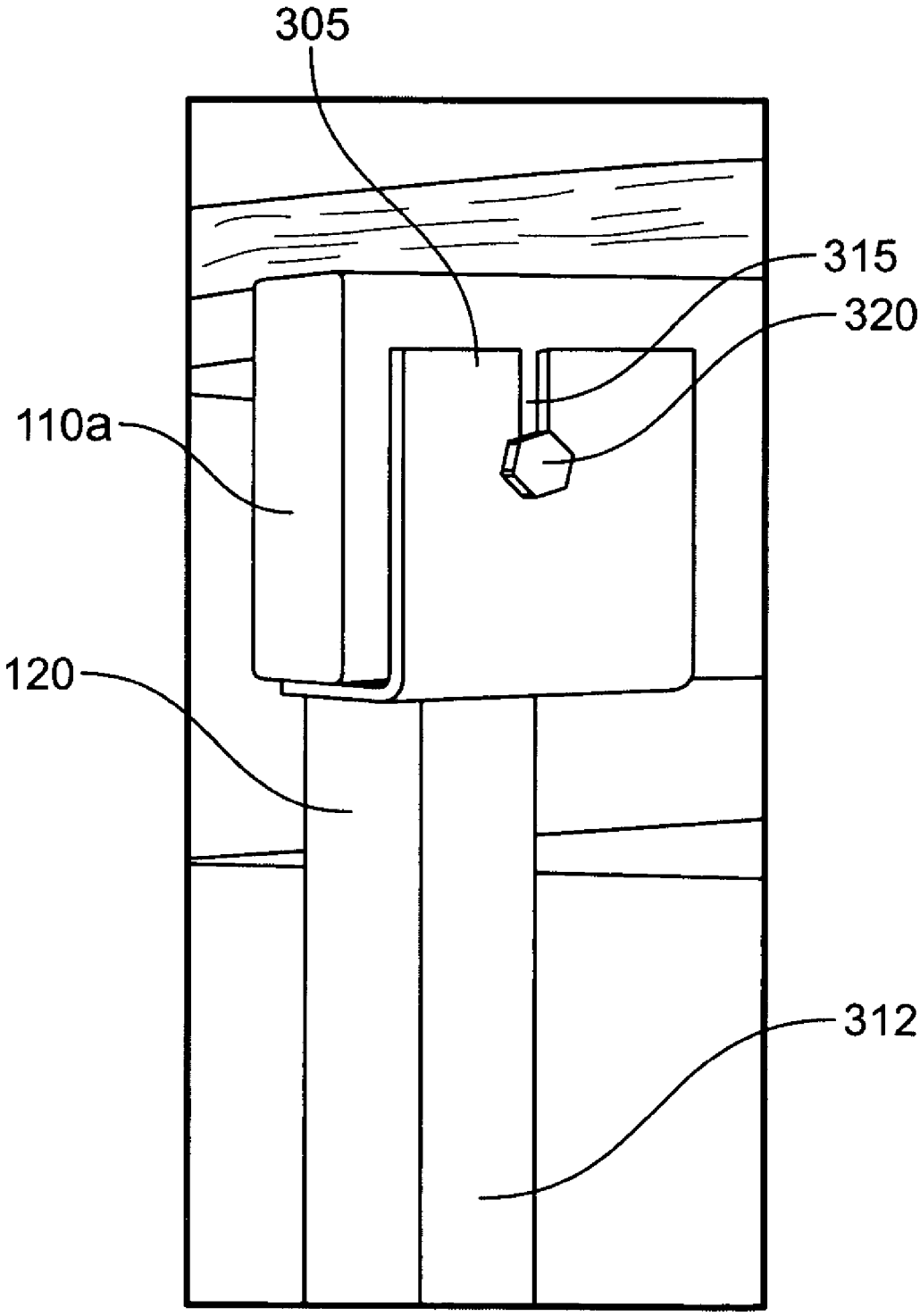
FIGS. 3A, 3B, 3C, and 3D are illustrations of a center support used in the palletizing system of FIGS. 1A and 1B.
Figure 3B:
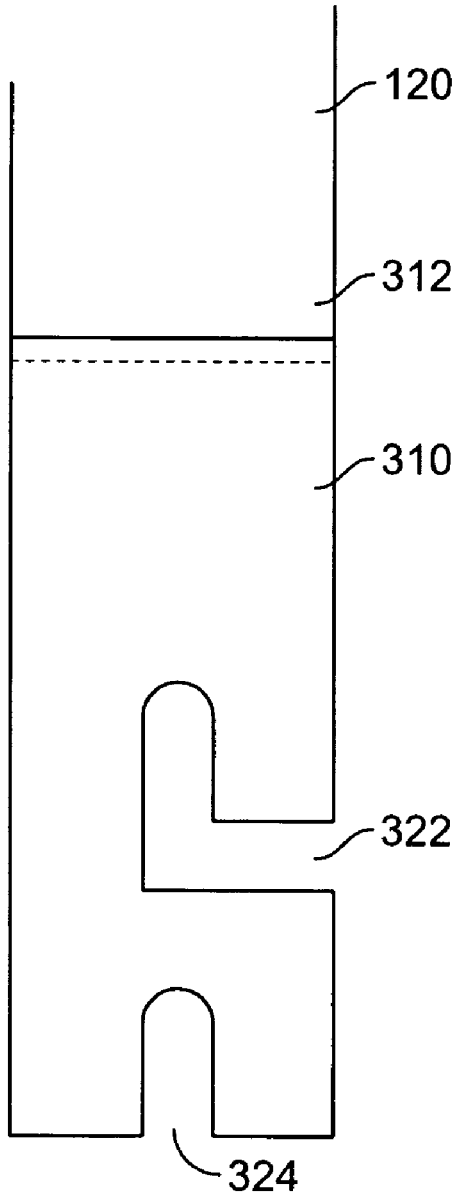
Figure 3C:
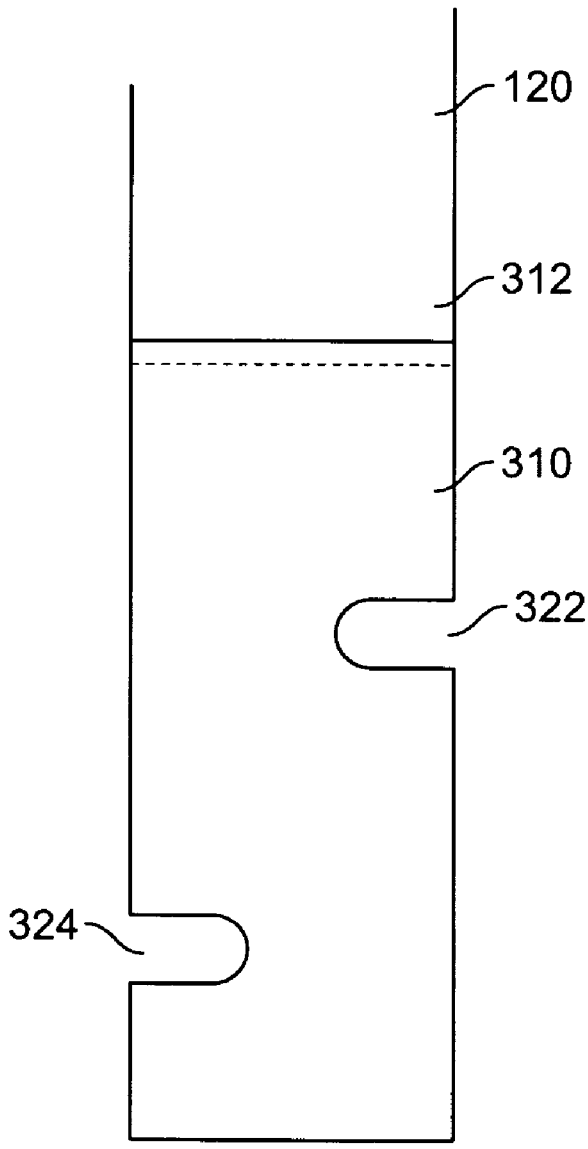
Figure 3D:
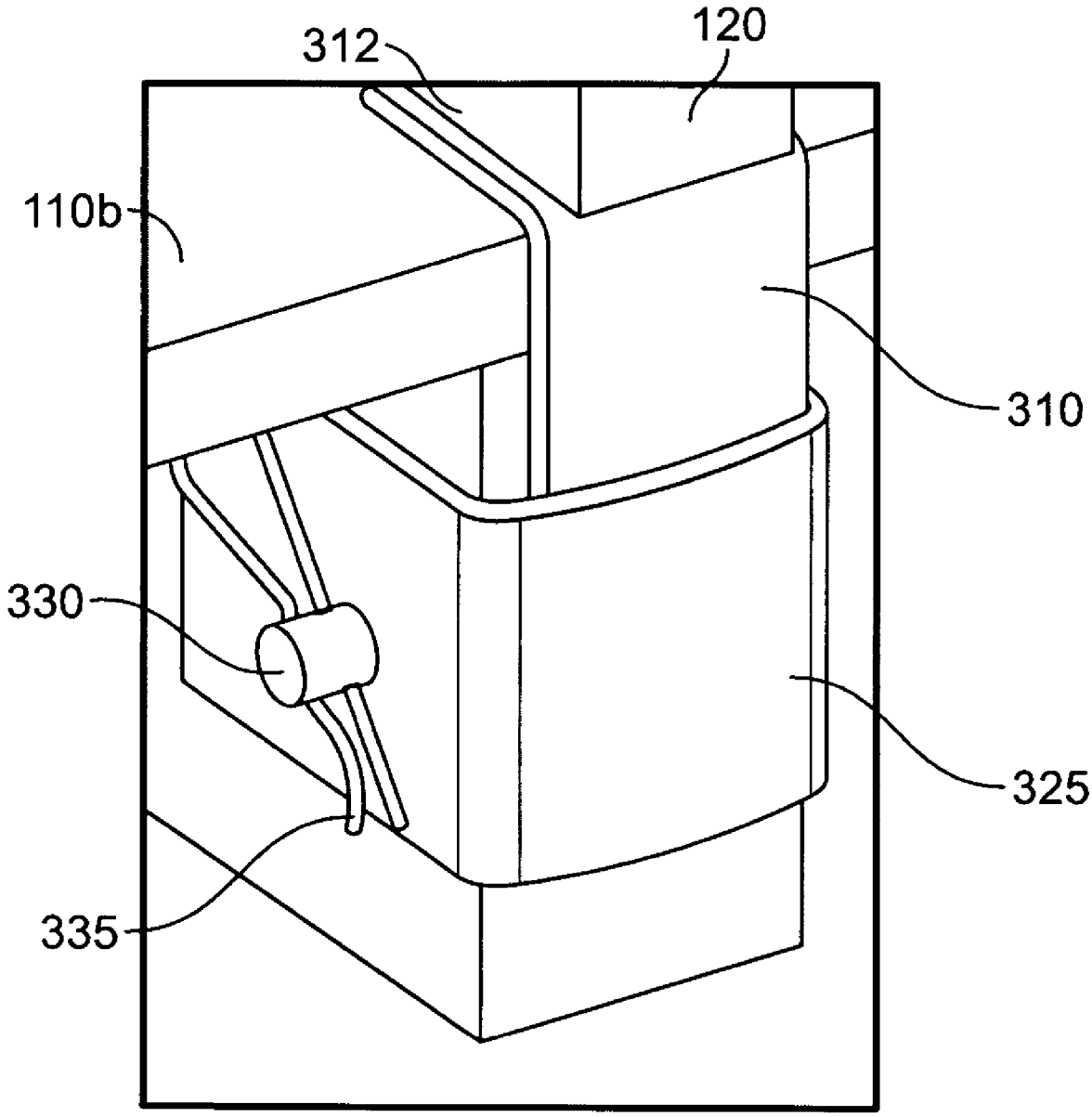

The upper and lower brackets 425*a* and 425*b* of the center support 420 are similar in structure to the lower bracket 310 of FIG. 3B. The upper bracket 425*a* extends around the bottom and the front of the center stringer of the first pallet 410*a*. The lower bracket 425*b* extends around the deck of the second pallet 410*b* and the front of the center stringer of the second pallet 410*b*. Lag screws may be used to directly attach the brackets 425*a* and 425*b* to the corresponding center stringers, or cleats may be used to secure the brackets 425*a* and 425*b* to the corresponding center stringers. Each cleat is similar to the cleat 325 of FIG. 3B in that the cleat extends around the front and two sides of the center stringer and the bracket in front of the center stringer. Clevis pins may extend through holes in the sides of the cleats and in the center stringers, and holding pins may extend through holes in the clevis pins to hold the clevis pins in place. Alternatively, lag screws, nuts and bolts, or other fasteners may be used to secure the cleats to the center stringers. The cleats may be attached to the upper and lower brackets 425*a* and 425*b*, and attachment hardware may be inserted into holes or slots in the attached cleats to secure the upper and lower brackets 425*a* and 425*b* to the center stringers. The cleats, clevis pins, holding pins, and lag screws collectively prevent the center support 420 from moving horizontally away from the pallets 410*a* and 410*b* and the second distribution transformer 405*b*, and enable the center support 420 to be easily removed when the palletizing system 400 is disassembled.

Figure 6:
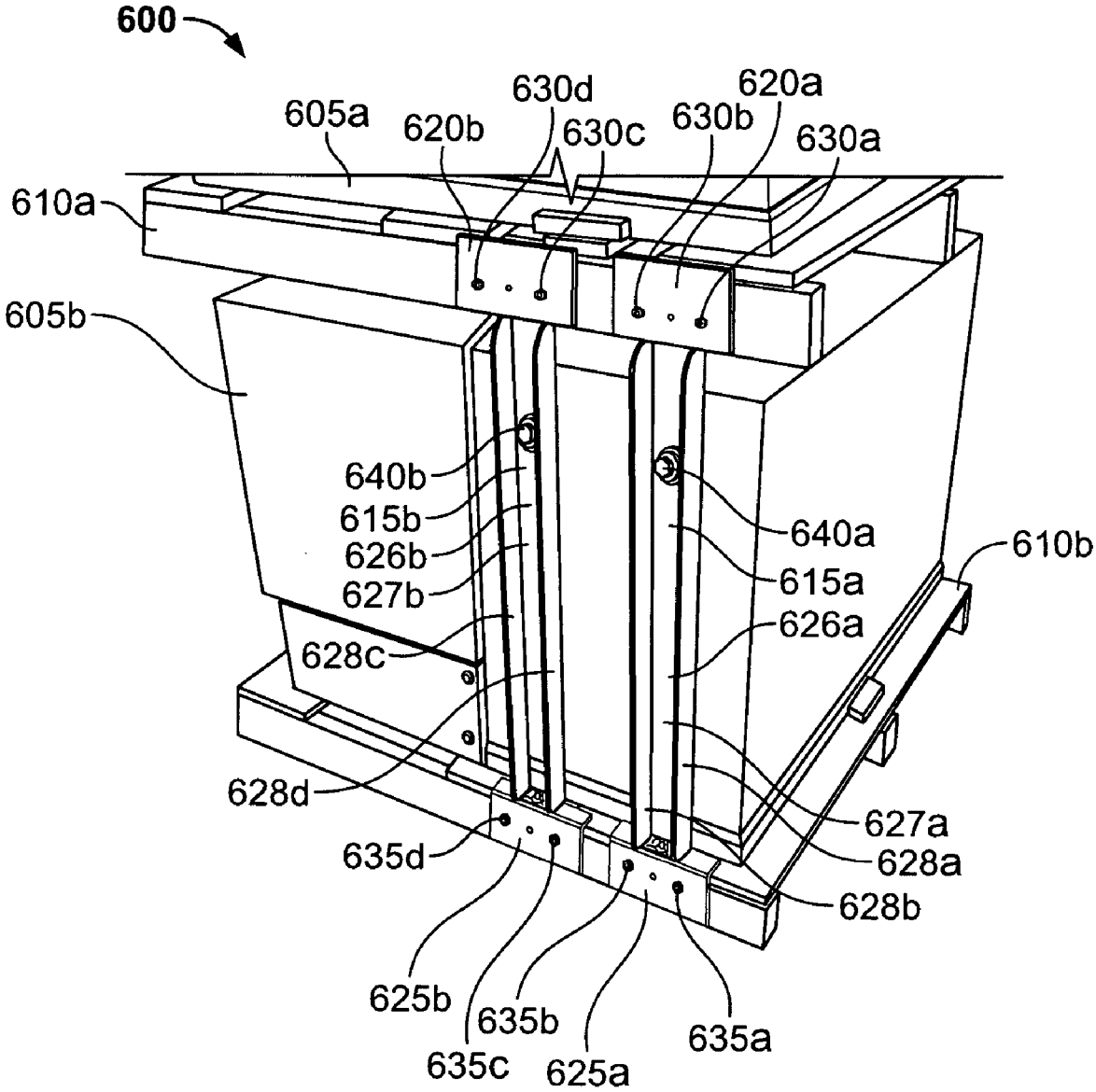
FIG. 6 is an illustration of another palletizing system.

Referring to FIG. 6, another palletizing system 600 is used to stack a first distribution transformer 605*a* above a second distribution transformer 605*b*. The distribution transformers 605*a* and 605*b* are mounted on pallets 610*a* and 610*b*, respectively. The palletizing system 600 includes four identical side supports, of which two side supports 615*a* and 615*b* are visible. The remaining side supports are located on an opposite side of the second distribution transformer 605*b*. Using four side supports provides sufficient strength to support the first distribution transformer 605*a* above the second distribution transformer 605*b* such that additional components for strength and stabilization of the palletizing system 600, such as a center support, are unnecessary. The side supports 615*a* and 615*b* include, respectively, upper brackets 620*a* and 620*b*, lower brackets 625*a* and 625*b*, and main shafts 626*a* and 626*b*. The main shafts 626*a* and 626*b* include first vertical pieces 627*a* and 627*b*, and additional vertical pieces 628*a*-628*d*. The side supports 615*a* and 615*b* are attached to the first pallet 610*a* with lag screws 630*a*-630*d* and to the second pallet 610*b* with lag screws 635*a*-635*d*. The side supports 615*a* and 615*b* are attached to the second distribution transformer 605*b* using bolts 640*a* and 640*b*, respectively.

The upper brackets 620*a* and 620*b* extend around the bottom and the outer side of one of the side stringers of the first pallet 610*a*, and the lower brackets 625*a* and 625*b* extend around the deck of the second pallet 610*b* and the outer side of one of the side stringers of the second pallet 610*b*. In either case, the brackets 620*a*, 620*b*, 625*a*, and 625*b* are attached to corresponding side stringers using one or more lag screws that are either directly driven directly through the brackets 620*a*, 620*b*, 625*a*, and 625*b* and the side stringers, or through cleats and spacers around the brackets 620*a*, 620*b*, 625*a*, and 625*b*. More particularly, lag screws 630*a* and 630*b* attach the bracket 620*a* to a side stringer of the first pallet 610*a*, and lag screws 630*c* and 630*d* attach the bracket 620*b* to the side stringer. Lag screws 635*a* and 635*b* attach the bracket 625*a* to a side stringer of the second pallet 610*b*, and lag screws 635*c* and 635*d* attach the bracket 625*b* to the side stringer. Different numbers of lag screws may be used to attach the brackets 620*a*, 620*b*, 625*a*, and 625*b* to the corresponding side stringers.

The main shaft 626*a* of the side support 615*a* extends between and connects the upper bracket 620*a* and the lower bracket 625*a*, and the main shaft 626*b* of the side support 615*b* extends between and connects the upper bracket 620*b* and the lower bracket 625*b*. The main shafts 627*a* and 627*b* are similar to the main shafts 212 of FIG. 2 and 525 of FIG. 5. The main shafts 626*a* and 626*b* include, respectively, first vertical pieces 627*a* and 627*b* that fit flat against the second distribution transformer 605*b*. The main shaft 626*a* includes the two additional vertical pieces 628*a* and 628*b*, and the main shaft 626*b* includes the two additional vertical pieces 628*c* and 628*d*. The additional vertical pieces 628*a*-628*d* are positioned relative to the vertical pieces 627*a* and 627*b* such that the main shafts 626*a* and 626*b* generally have the form of rectangular channels. The vertical pieces 627*a* and 627*b* of the main shafts 626*a* and 626*b* of the side supports 615*a* and 615*b* include holes through which bolts 640*a* and 640*b* are driven to attach the side supports 615*a* and 615*b* to the second distribution transformer 605*b* at lift bolt provisions of the second distribution transformer 605*b*. In one implementation, washers are used with the bolts 640*a* and 640*b*.

Figure 7:
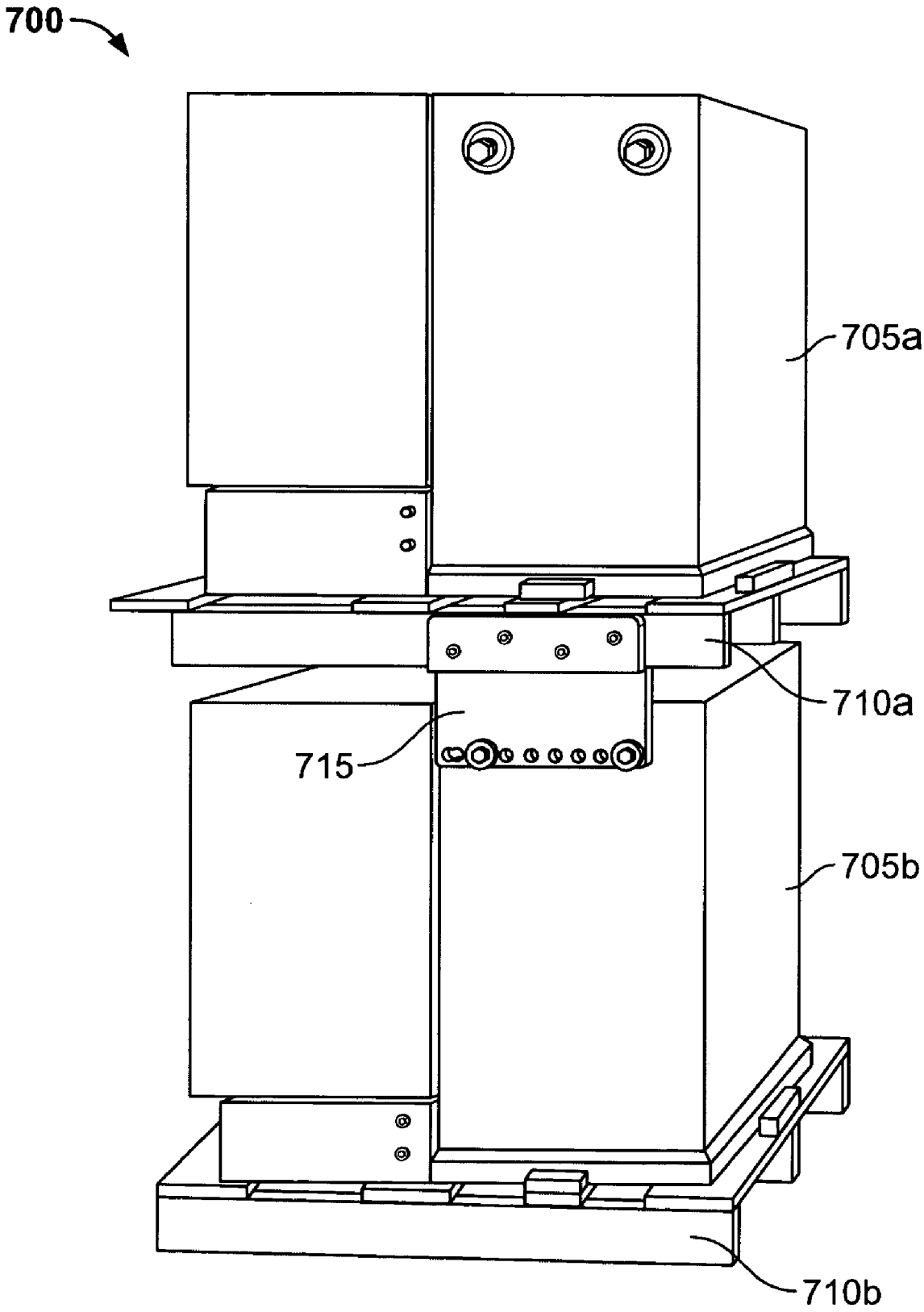
FIG. 7 is an illustration of another palletizing system.

Referring to FIG. 7, another palletizing system 700 may be used to stack a first distribution transformer 705*a* above a second distribution transformer 705*b*. The distribution transformers 705*a* and 705*b* are mounted on pallets 710*a* and 710*b*, respectively. The palletizing system 700 includes two side supports on opposite sides of the second distribution transformer 705*b*, of which only one side support 715 is visible. The side supports are wide enough to provide sufficient strength to support the first distribution transformer 705*a* above the second distribution transformer 705*b* such that additional components, such as a center support, for strength and stabilization of the palletizing system 700 are unnecessary. However, some implementations of the palletizing system 700 may include a center support, such as the center support 120 of FIG. 11B or the center support 420 of FIG. 4. The center support may reduce stress in the side support 715 when a strap across the top of the palletizing system 700 is tightened.

Figure 8:
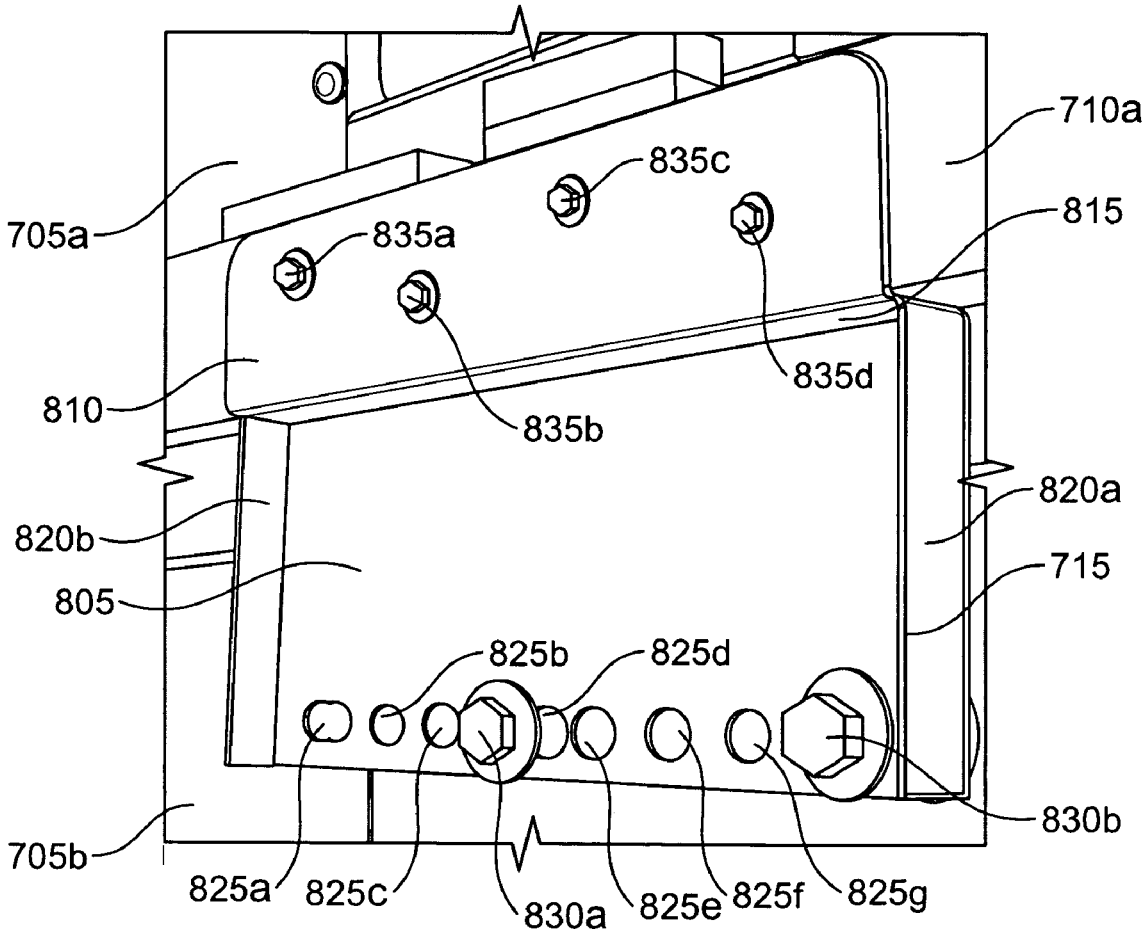
FIG. 8 is an illustration of a side support used in the palletizing system of FIG. 7.

The side support 715 is attached near the top of the second distribution transformer 705*b* and extends above the second distribution transformer 705*b* such that the first distribution transformer 705*a* may be supported by the side support 715 above the second distribution transformer 705*b*. Referring also to FIG. 8, the side support 715 includes vertical pieces 805 and 810 that are connected by a horizontal piece 815. Bracing pieces 820*a* and 820*b* are optionally included to provided additional strength to the side support 715. The side support 715 includes holes 825*a*-825*g* through which the bolts 830*a* and 830*b* may be driven to attach the side support 715 to the second distribution transformer 705*b*. Lag screws 835*a*-835*d* are used to attach the side support 715 to the first pallet 710*a*.

The vertical piece 805 attaches to the second distribution transformer 705*b*, and the vertical piece 810 attaches to the first pallet 710*a*. The top of the vertical piece 805 and the bottom of the vertical piece 810 attach to opposite sides of the horizontal piece 815. When attached to the distribution transformer 705*b*, the side support 715 is oriented such that the vertical piece 805 is below the vertical piece 810. In addition, the side support 715 is oriented such that its horizontal piece 815 extends away from the center of the second distribution transformer 705*b*. Therefore, the first pallet 710*a* sits on the horizontal piece 815 of the side support 715 and against the upper vertical piece 810.

The side support 715 also may include two bracing pieces 820*a* and 820*b* that brace the side support 715 and provide additional strength to the side support 715. The bracing pieces 820*a* and 820*b* are perpendicular to and connect to both the horizontal piece 815 and the lower vertical piece 805. The bracing pieces 820*a* and 820*b* support the horizontal piece 815, which bears the majority of the weight of the first distribution transformer 705*a* and the first pallet 710*a*.

The bottom of the vertical piece 805 includes a series of holes 825*a*-825*g* through which the bolts 830*a* and 830*b* are driven to attach the side support 715 to the second distribution transformers 705*b*. The bolts 830*a* and 830*b*, which may be used with washers in some implementations, are driven through two of the holes 825*a*-825*g* into lift bolt provisions of the second distribution transformer 705*b*. Therefore, the side support 715 may only be used with distribution transformers include at least two lift bolt provisions on the left and right sides of the distribution transformers. If the side support 715 is used with a distribution transformer with a single lift bolt provision on the left and right sides, each side support 715 may rotate about the single lift bolt provision.

The multiple holes 825*a*-825*g* allow flexibility in the placement of the side support 715 relative to the lift bolt provisions. More particularly, multiple pairs of holes through which the bolts 830*a* and 830*b* may be driven are provided by the holes 825*a*-825*g*. Each pair of holes has a different location relative to the side support 715 such that the side support 715 may be placed in multiple positions relative to the lift bolt provisions. As a result, side supports on opposite sides of the second distribution transformer 705*b* may be offset from one another, rather than being directly across from one another. Offsetting the side supports may ensure balance of the first distribution transformer 705*a* when hoisting the palletizing system 700. Furthermore, the multiple holes 825*a*-825*g* are symmetrically placed relative to the center of the vertical piece 805, which allows identical side supports to be used on the opposite sides of the second distribution transformer 705*b*. The multiple holes 825*a*-825*g* also allow the side support 715 to be used with multiple types of distribution transformers with varying locations for and distances between corresponding lift bolt provisions. Side supports with fewer holes also may be used in the palletizing system 700, though such side supports may only be used with a more limited variety of distribution transformers and may only be used on one side of the distribution transformers.

In some implementations, one of the bolts 830*a* or 830*b* is driven through one of the holes 825*a*-825*g* that is closest to one of the bracing pieces 820*a* or 820*b*. For example, the bolt 830*b* is driven through a hole that is next to the bracing piece 820*a*. In such implementations, each of the remaining holes 825*a*-825*g* are positioned at distances from the end hole through which one of the bolts 830*a* or 830*b* is driven that equal the distances between lift bolt provisions in the multiple types of distribution transformers with which the side support 715 is used. In other implementations, one of the bolts 830*a* and 830*b* is not necessarily in an end hole of the side support 715, which may allow for a reduction in the number of holes in the series of holes 825*a*-825*g*. More particularly, the distances between the lift bolt provisions of the multiple types of distribution transformers with which the side support 715 is used may be found between internal pairs of holes in the series of holes 825*a*-825*g*, which allows for the reduction in the number of holes in the series of holes 825*a*-825*g*.

The vertical piece 810 is attached to one of the side stringers of the first pallet 710*a* using the lag screws 835*a*-835*d*. The lag screws 835*a*-835*d*, which may be used with washers in some implementations, are driven through holes in the vertical piece 810 into the side stringer. The holes in the vertical piece 810 and the lag screws 835*a*-835*d* are staggered to minimize the likelihood that the lag screws 835*a*-835*d* lie along a single strand of grain of the side stringer and collectively act like wedges to split the stringer. The vertical piece 810 may include more holes for lag screws than are strictly required to allow for the possibility of shearing lag screws as the first distribution transformer 705*a* is mounted above the second distribution transformer 705*b* on the side support 715. Alternatively or additionally, bolts, cleats, pins, or other attachment hardware may be used to attach the vertical piece 810 to the side stringer.

The side support 715 optionally may include one or more slots in the middle of the vertical piece 805. Straps or bands may be passed through the slots and around the first distribution transformer 705*a* and the first pallet 710*a* to secure the first distribution transformer 705*a* and the first pallet 710*a* to the side support 715 and to increase the stability of the palletizing system 700.

Figure 9:
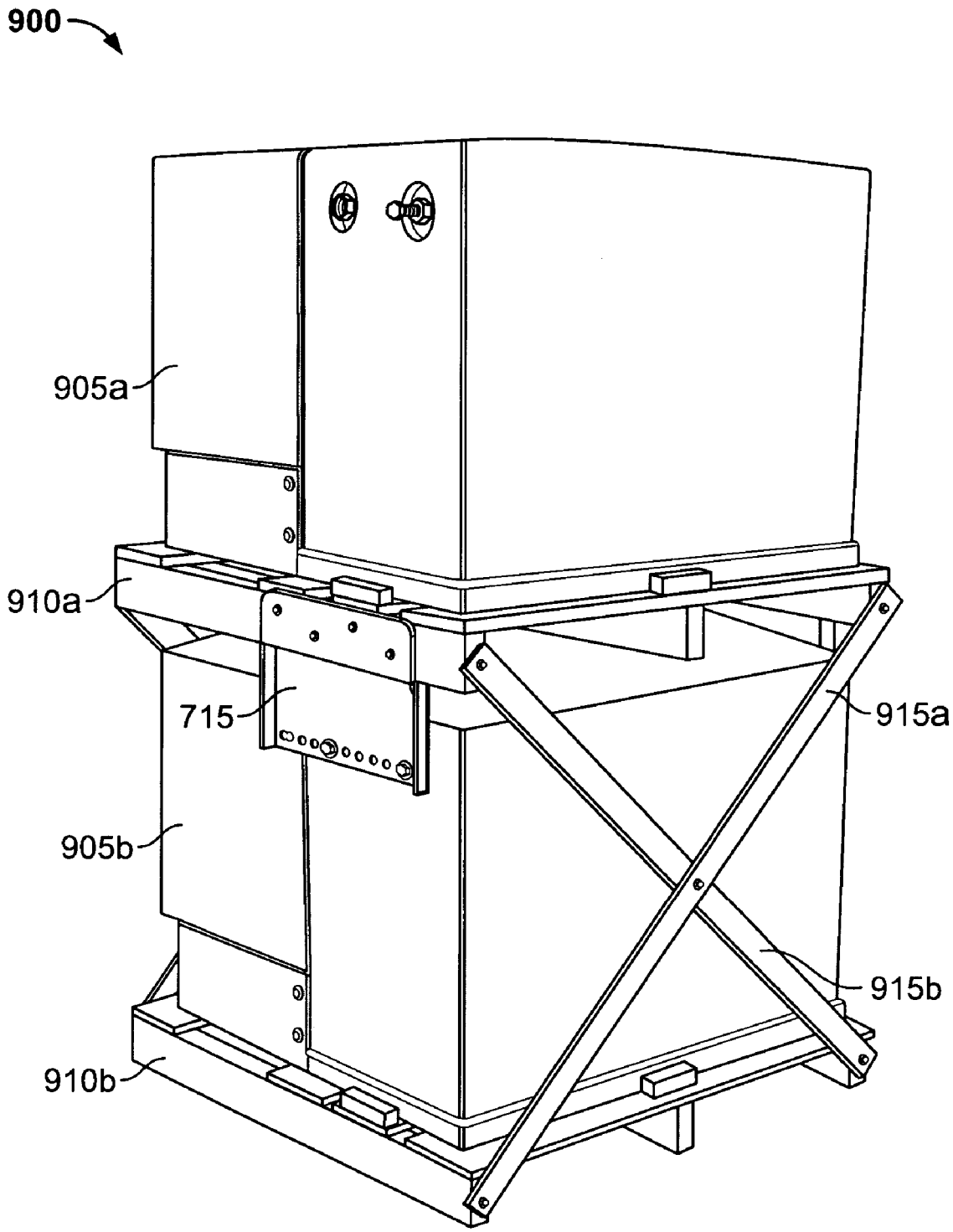
FIG. 9 is an illustration of another palletizing system.

Referring to FIG. 9, another palletizing system 900 may be used to stack a first distribution transformer 905*a* above a second distribution transformer 905*b*. The distribution transformers 905*a* and 905*b* are mounted on pallets 910*a* and 910*b*, respectively. The palletizing system 900 is similar to the palletizing system 700 of FIG. 7 in that the palletizing system 900 supports the first distribution transformer 905*a* above the second distribution transformer 910*b* using side supports, such as the side support 715. In addition, the palletizing system 900 uses two pairs of bracing bars, of which bracing bars 915*a* and 915*b* are visible, to further strengthen and stabilize the palletizing system 900. The bracing bars reduce lateral and twisting motion of the first distribution transformer 905*a* and the first pallet 910*a* relative to the second distribution transformer 905*b* and the second pallet 910*b*.

The bracing bars 915*a* and 915*b* are attached to the ends of the side stringers, or to the decks, of the pallets 910*a* and 910*b*. Therefore, each pair of bracing bars is located on a side of the second distribution transformer 905*b* to which a side support 715 is not attached. The bracing bars 915*a* and 915*b* may be long flat pieces of steel, solid or hollow pieces of metal with square, rectangular, or round cross sections, "L"-shaped pieces of metal, or pieces of metal shaped as channels. Alternatively, the bracing bars 915*a* and 915*b* may be cables or some other component that braces the palletizing system 900 with tension. The bracing bars 915*a* and 915*b* are attached with lag screws to the ends of the appropriate side stringers. The bracing bars connect a side stringer on one side of the pallet 910*a* to a side stringer on an opposite side of the pallet 910*b*. Therefore, the bracing bars 915*a* and 915*b* intersect, and the bracing bars 915*a* and 915*b* may be connected with a lag screw, bolt, pin, or other attachment hardware at the point of intersection. In general, the palletizing system 900 may include two, one, or no bracing bars attached to the pallets 910*a* and 910*b* on one or more sides of the second distribution transformer 905*b* to which a side support 715 is not attached.

Figure 10:
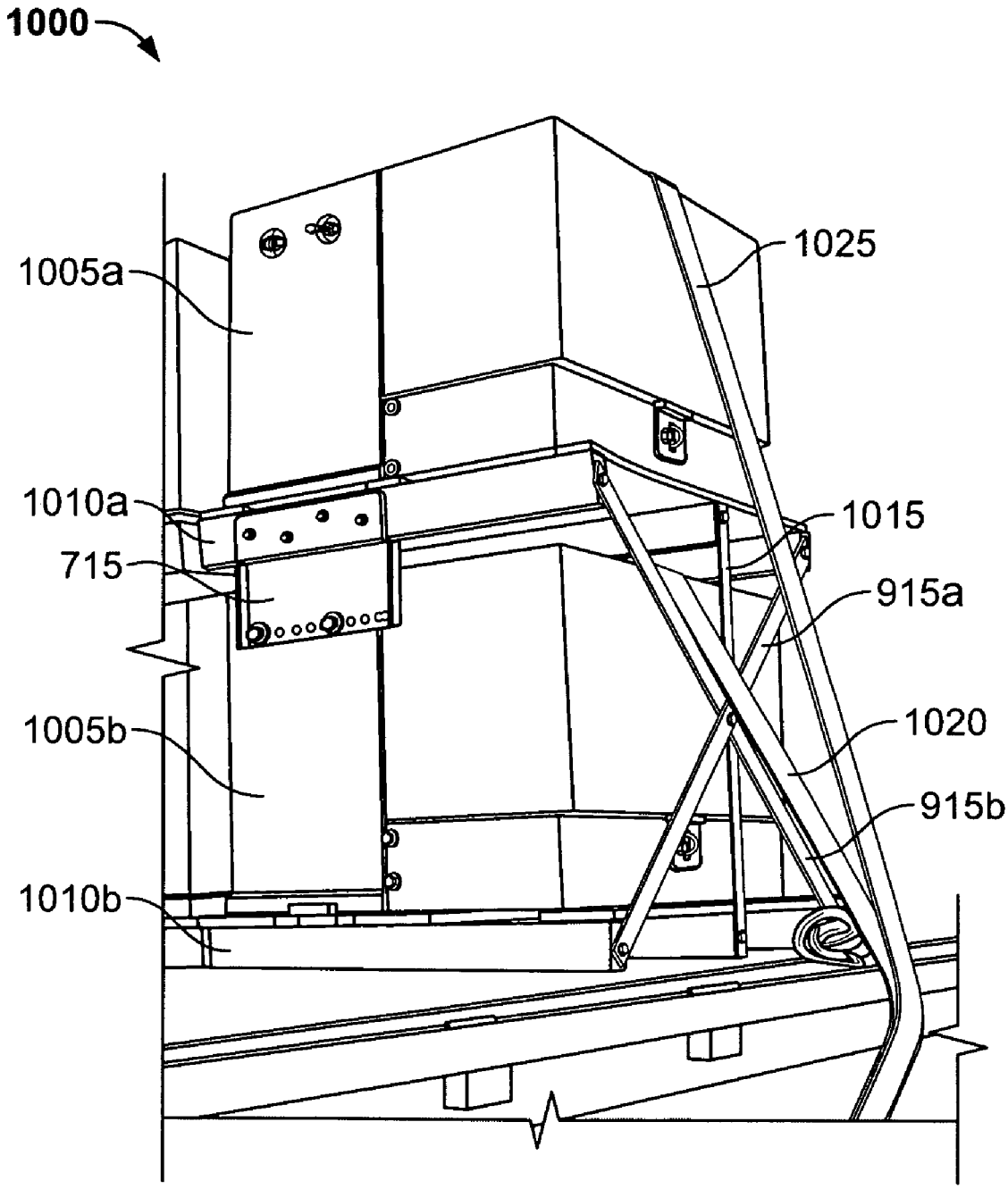
FIG. 10 is an illustration of another palletizing system.

Referring to FIG. 10, a sixth implementation of a palletizing system 1000 may be used to stack a first distribution transformer 1005*a* above a second distribution transformer

1005*b* that are mounted on pallets 1010*a* and 1010*b*, respectively. The palletizing system 1000 is similar to the palletizing system 900 of FIG. 9. More particularly, the palletizing system 1000 includes side supports, such as the side support 715, and bracing bars, such as the bracing bars 915*a* and 915*b*, to support the first distribution transformer 1005*a* above the second distribution transformer 1005*b* in a stable manner. In addition, the palletizing system 1000 includes two additional bracing bars, such as the bracing bar 1015, and two straps 1020 and 1025 to further strengthen and stabilize the palletizing system 1000.

The bracing bar 1015 is attached to ends of the center stringers of the pallets 1010*a* and 1010*b*. Therefore, the bracing bar 1015 extends vertically between the first pallet 1010*a* and the second pallet 1010*b*. Like the bracing bars 915*a* and 915*b*, the bracing bar 1015 may be a long flat piece of steel, a solid or hollow piece of metal with a square, rectangular, or round cross section, an "L"-shaped piece of metal, or a piece of metal shaped as a channel. Alternatively, the bracing bar 1015 may be a cable or some other component that braces the palletizing system 1000 with tension. The bracing bar 1015 intersects the bracing bars 915*a* and 915*b* at the same point at which the bracing bars 915*a* and 915*b* intersect. The bracing bars 915*a*, 915*b*, and 1015 may be connected with a lag screw, bolt, pin, or other attachment hardware at the point of intersection.

The palletizing system 1000 also includes straps 1020 and 1025 that are tightened around one or more of the first distribution transformer 1005*a*, the second distribution transformer 1005*b*, the first pallet 1010*a*, and the second pallet 1010*b* to stabilize and strengthen the palletizing system 1000. As illustrated in FIG. 10, the strap 1020 extends around the second distribution transformer 1005*b* and the second pallet 1010*b*, and the strap 1025 extends around the first distribution transformer 1005*a*, the second distribution transformer 1005*b*, the first pallet 1010*a*, and the second pallet 1010*b*. In addition, one or more of the straps 1020 and 1025 may extend around a surface on which the palletizing system 1000 sits, such as a deck of a truck used to ship the distribution transformers 1005*a* and 1005*b*, to secure the palletizing system 1000 to the surface. The straps 1020 and 1025 may be tightened around components of a single palletizing system 1000 or of multiple adjacent palletizing systems 1000.

Figure 11:
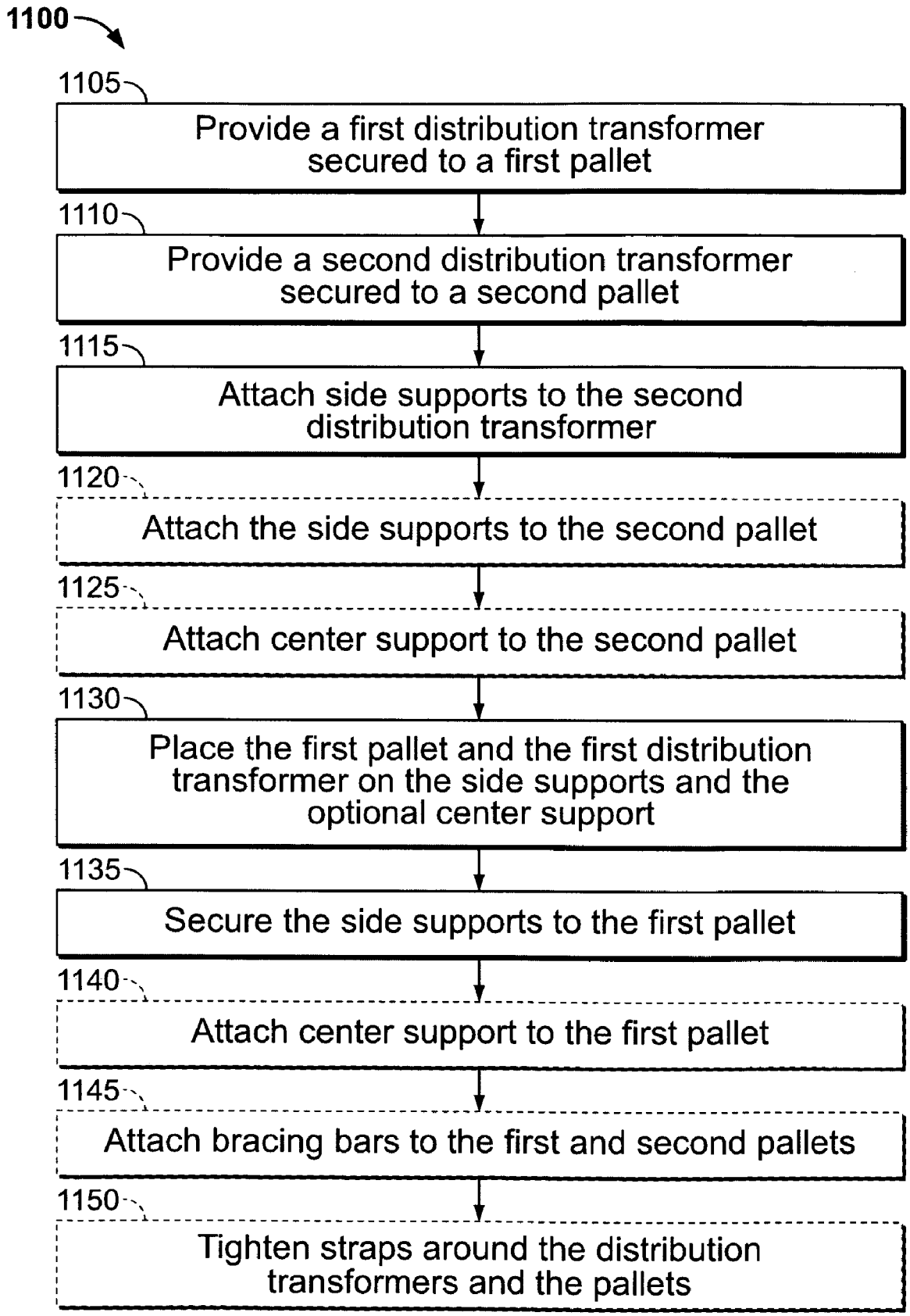
FIG. 11 is a flow chart of a process for stacking multiple distribution transformers for shipping and storage.

Referring to FIG. 11, a process 1100 is used to assemble the palletizing systems 100, 400, 600, 700, 900, and 1000 that enable more space efficient shipping and storage of multiple distribution transformers. The process 1100 constructs a palletizing system that suspends a first distribution transformer and a first pallet on supports that are mounted to a second distribution transformer and a second pallet. In addition, the process 1100 may add bracing bars and straps to the palletizing system to stabilize and strengthen the palletizing system.

The process 1100 begins when a first distribution transformer that is secured to a first pallet is provided (step 1105), along with a second distribution transformer that is secured to a second pallet (step 1110). The first and second distribution transformers may be secured to the first and second pallets, respectively, with one or more lag screws. The palletizing system constructed with the process 1100 stacks the first distribution transformer and the first pallet above the second distribution transformer and the second pallet.

Next, side supports are attached to the second distribution transformer (step 1115). The side supports may be two or more of the side support 115*a* of FIG. 2, 415 of FIG. 4, 615*a* or 615*b* of FIG. 6, or 715 of FIG. 7. The side supports may be attached to the second distribution transformer with bolts driven into lift bolt provisions of the second distribution transformer. One or more side supports may be attached at corresponding lift bolt provisions, with one or more bolts and washers attaching each side support to the second distribution transformer.

The side supports that have been attached to the second distribution transformer optionally may be attached to the second pallet (step 1120). More particularly, the side supports may be attached to side stringers of the second pallet. In implementations where the side supports are similar to the side supports 115*a*, 415, 615*a*, or 615*b*, the side supports include lower yokes or brackets, such as the lower yoke 210 of FIG. 2, the bracket 505 of FIG. 5, and the lower brackets 625*a* and 625*b* of FIG. 6, that contact the second pallet. In some of those implementations, the lower brackets or yokes are attached to the second pallet with lag screws that may be used in conjunction with cleats and spacers. Alternatively, the lower portions may be held to the second pallet by the weight of the first distribution transformer and the first pallet that is supported by the side supports. In implementations where the side supports are similar to the side supports 715, the side supports do not contact and are not attached to the second pallet.

In some implementations, a center support, such as the center support 120 of FIG. 1B and the center support 420 of FIG. 4, may be added to the palletizing system to provide additional support for the first distribution transformer above the second distribution transformer. In such implementations, the center support is attached to the second pallet (step 1125). More particularly, the center support is attached to a center stringer of the second pallet. The center support may include a lower bracket, such as one of the lower brackets 310 of FIG. 3 and 425*b* of FIG. 4, that extends around the deck of the second pallet and the front of the center stringer. The lower bracket may be directly attached to the center stringer with lag screws driven through the lower bracket into the front of the center stringer. Alternatively or additionally, the lower bracket may be held to the second pallet with a cleat that extends around the lower bracket and around the front and two sides of the center stringer. The cleat may be attached to the center stringer with a clevis pin and a holding pin, lag screws, bolts, or other attachment hardware.

The first pallet and the first distribution transformer are placed on the side supports and the optional center support to stack the first distribution transformer above the second distribution transformer (step 1130). The first pallet and the first distribution transformer are placed on upper brackets or yokes of the side supports and the center support, such as the upper yokes 205 of FIG. 2 and 305 of FIG. 3, and the upper brackets 425*a* of FIG. 4, 505 of FIG. 5, and 620*a* and 620*b* of FIG. 6, that extend above the top of the second distribution transformer.

The side supports then are secured to the first pallet (step 1135). More particularly, the upper yokes or brackets are attached to side stringers of the first pallet. In one implementation, lag screws, bolts, or other fasteners are driven directly through holes in the upper yokes or brackets into the side stringers to attach the side supports to the first pallet. In another implementation, lag screws are driven through cleats and spacers that hold the upper yokes or brackets to the side stringers. In yet another implementation, lag screws may be partially driven into the side stringers through slots in the upper yokes or brackets that facilitate disassembly of the palletizing system to secure the side supports to the first pallet.

In implementations where the palletizing system includes a center support, the center support also is attached to the first pallet (step 1140). The center support includes an upper yoke or bracket that is attached to a center stringer of the first pallet with one or more lag screws, bolts, or other attachment hardware. Alternatively or additionally, the upper bracket or yoke may be attached to the center stringer with a cleat that extends around the upper bracket and around the front and two sides of the center stringer. The cleat may be attached to the center stringer with a clevis pin and holding pin, lag screws, bolts, or other attachment hardware. In yet another implementation, lag screws may be partially driven into the center stringer through a slot in the upper yoke or bracket that facilitates disassembly of the palletizing system to secure the center stringer to the upper yoke or bracket.

Bracing bars may be attached to the first and second pallet to further strengthen and stabilize the palletizing system (step 1145). In some implementations, the palletizing system includes two pairs of bracing bars, such as the bracing bars 915*a* and 915*b* of FIG. 9, that are attached to ends of the side stringers of the first and second pallets. Each pair of bracing bars is attached to the ends of the side stringers with lag screws, or other attachment hardware, such that the bracing bars intersect, and the bracing bars may be attached to one another at the point of intersection with a bolt, lag screw, or other attachment hardware. In one of the above implementations, the pairs of bracing bars each may include a third bracing bar, such as the bracing bar 1015 of FIG. 10, that is attached to the ends of center stringers of the first and second pallets such that the third bracing bar intersects the other two bracing bars of the pair at the same point of intersection, and the three bracing bars may be attached to one another at the point of intersection.

Straps also may be tightened around the distribution transformers and the pallets (step 1150). The straps provide additional stability and strength to the palletizing system. The straps may be in any orientation and may extend around one or both of the distribution transformers and the pallets. For example, one strap, such as the strap 230 of FIG. 2, which allows for safe forklift handling of the palletizing system, may be tightened around corresponding side stringers of the first pallet and the second pallet. In one implementation, the straps are steel banding, plastic banding, a metal strip, or a metal strut. Other examples of straps that may be tightened around the palletizing system include the straps 1020 and 1025 of FIG. 10, which may be added when the palletizing assembly is to be shipped. The straps may extend around a surface on which the palletizing system sits, such as a deck of a truck used to ship the distribution transformers.

The supporting pieces of the various implementations of a palletizing system, such as the side supports, the center supports, the cleats, and the various pieces of attachment hardware, may be made of 10 gauge steel, or any other kind of steel having adequate strength to sustain shipping and handling stresses. The supporting pieces each may be a single piece of bent or otherwise shaped metal, or multiple pieces of metal that have been welded together. The supporting pieces, or components thereof, may be created specifically for space efficient transformer stacking applications. Alternatively, the supporting pieces, or the components thereof, may be generic and commercially available components.

Specific examples of fasteners or attachment hardware, such as screws, bolts, and pins are provided throughout for use in attaching components of the various implementations of a palletizing system. However, any suitable fastener or attachment hardware may be used to attach the components of the palletizing system. For example, bolts that are used with or without nuts and washers may be used in place of lag screws or clevis pins.

Components of the various implementations of a palletizing system for stacking multiple distribution transformers for space efficient storage and shipping that have been described, and features of those components, may be combined to produce other implementations of the palletizing system. For example, side supports from a first implementation described with respect to FIGS. 1A and 1B may be combined with the center support from a second implementation described with respect to FIG. 4 to create an additional implementation of the palletizing system. In addition, components of one implementation, and features thereof, may be replaced with corresponding components from another implementation. For example, the side supports from a third implementation described with respect to FIG. 6 may be replaced with the side supports from the first implementation. Furthermore, components from one implementation, and features thereof, may be added to another implementation to provide additional strength or stability to the implementation. For example, the bracing bars from a fifth implementation described with respect to FIG. 9 may be added to any of the other implementations. As another example, the second implementation may be made to include four side supports, as is done in the third implementation. Finally, components of an implementation, such as the strap from the first implementation, may be removed when unnecessary.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A system for stacking distribution transformers for shipping and storage, the system comprising:

a first pallet to which a first distribution transformer is attached;

a second pallet to which a second distribution transformer is attached; and two vertically extending side supports on opposite sides of the second distribution transformer that support the first pallet above the second pallet, with each side support contacting the second distribution transformer and being attached to the second distribution transformer using a threaded device that is fixedly attached to the second distribution transformer at a lift bolt provision of the second distribution transformer, wherein each side support includes an upper yoke in which a side stringer of the first pallet fits, wherein the side supports directly contact the second pallet such that the side supports are at least partly supported by the second pallet and such that most of the weight of the first distribution transformer is supported directly by the second pallet through the upper yoke and side supports, wherein the upper yoke is a U-shaped piece defining an internal rectangular channel into which the side stringer fits; and the upper yoke is attached to the side stringer with a fastener; and the upper yoke includes a slot around the fastener that allows the side stringer to be removed from the upper yoke without fully removing the fastener.

2. The system of claim 1, wherein each side support includes a lower yoke in which a side stringer of the second pallet fits.

3. The system of claim 1, further comprising a strap wrapped around at least one component of at least one of the first pallet, the second pallet, the first distribution transformer, and the second distribution transformer.

4. The system of claim 1, wherein each side support includes a lower yoke that defines an internal rectangular channel into which a side stringer of the second pallet fits.

5. A system for stacking distribution transformers for shipping and storage, the system comprising:

a first pallet to which a first distribution transformer is attached;

a second pallet to which a second distribution transformer is attached;

two side supports on opposite sides of the second distribution transformer that support the first pallet above the second pallet, with each side support contacting the second distribution transformer and being attached to the second distribution transformer using attachment hardware that is fixedly attached to the second distribution transformer at a lift bolt provision of the second distribution transformer and each side support being attached to the first pallet; and a center support having attachment hardware that connects to the first pallet to attach the first pallet to the second pallet on a side of the second distribution transformer different from the sides of the second distribution transformer to which the side supports are attached, wherein each side support includes an upper yoke that is a U-shaped piece defining an internal rectangular channel into which the side stringer fits; and the upper yoke is attached to the side stringer with a fastener; and the upper yoke includes a slot around the fastener that allows the side stringer to be removed from the upper yoke without fully removing the fastener.

6. The system of claim 5, wherein the center support attachment hardware includes an upper yoke in which a center stringer of the first pallet fits.

7. The system of claim 6, wherein:

the upper yoke is attached to the center stringer with a fastener; and the upper yoke includes a slot around the fastener that allows the center stringer to be removed from the upper yoke without fully removing the fastener.

8. The system of claim 5, wherein the center support includes a lower bracket that fits around a center stringer of the second pallet.

9. The system of claim 8, wherein the lower bracket is held to the center stringer with a cleat that fits around the center stringer and the lower bracket.

10. The system of claim 5, wherein the center support attachment hardware includes an upper bracket that fits around a center stringer of the first pallet.

11. The system of claim 5, wherein each side support is attached to the second distribution transformer at only one attachment location.

12. The system of claim 5, wherein each side support includes a lower yoke that defines an internal rectangular channel into which a side stringer of the second pallet fits.

13. A method for supporting a first distribution transformer above a second distribution transformer, the method comprising:

providing a first pallet on top of which a first distribution transformer is attached;

providing a second pallet on top of which a second distribution transformer is attached;

attaching two vertically extending side supports to opposite sides of the second distribution transformer such that upper support surfaces of the two side supports extend above an upper surface of the second distribution transformer and such that the side supports directly contact the second pallet by contacting each of the side supports to the second distribution transformer by fixedly attaching a threaded device to the second distribution transformer at a lift bolt provision of the second distribution transformer;

placing the first pallet on the side supports above the second distribution transformer;

securing the first pallet to the side supports using an upper yoke by fitting a side stringer of the first pallet into the upper yoke and securing the side stringer to the upper yoke;

at least partly supporting each side support with the second pallet by the direct contact made between the side support and the second pallet such that the weight of the first distribution transformer is supported by the second pallet through the upper yoke and the side supports, wherein fitting the side stringer of the first pallet into the upper yoke includes fitting the side stringer of the first pallet into an internal rectangular channel defined by two opposed sides and one side that connects the two opposed of the upper yoke and;

wherein securing the first pallet to the side supports comprises installing fasteners into the side stringer though slots in the upper yoke that allows the side stingers to be disengaged from the upper support surfaces without fully removing the fasteners.

14. The method of claim 13, wherein attaching side supports to opposite sides of the second distribution transformer comprises attaching main shafts of the side supports to the second distribution transformer at lift bolt provisions of the second distribution transformer with bolts driven through holes in the side supports.

15. The method of claim 13, further comprising placing lower yokes of the side supports around side stringers of the second pallet.

16. The method of claim 13, wherein securing the first pallet to the side supports comprises securing cleats around the upper support surfaces to the side stringers of the second pallet.

17. The method of claim 13, further comprising attaching a center support to the first pallet and to the second pallet.

18. The method of claim 17, wherein attaching the center support to the first pallet and to the second pallet comprises:

securing a lower support surface of the center support to a center stringer of the second pallet; and securing an upper support surface of the center support to a center stringer of the first pallet.

19. The method of claim 18, wherein securing the upper support surface of the center support to the center stringer of the first pallet comprises installing a fastener into the center stringer through a slot in the upper support surface that allows the center stringer to be disengaged from the upper support surface without fully removing the fastener.

20. The method of claim 18, wherein securing the center stringer of the second pallet to the lower support of the center support comprises securing a cleat around the lower support and the center stringer.

21. The method of claim 13, further comprising tightening a strap around at least one component of at least of one of the first pallet, the second pallet, the first distribution transformer, and the second distribution transformer.

22. A system for stacking distribution transformers for shipping and storage, the system comprising:

a first pallet to which a first distribution transformer is attached;

a second pallet to which a second distribution transformer is attached; and two vertically extending side supports on opposite sides of the second distribution transformer that support the first pallet above the second pallet, with each side support contacting the second distribution transformer and being attached to the second distribution transformer using a threaded device that is fixedly attached to the second distribution transformer at a lift bolt provision of the second distribution transformer;

wherein each side support comprises a main shaft that extends between the first pallet and the second pallet, and an upper yoke into which a side stringer of the first pallet fits, with each side support directly contacts the second pallet, and each side support is substantially parallel to a side of the second distribution transformer closest to the side support such that most of the weight of the first distribution transformer is supported directly by the second pallet through the upper yoke and side supports, wherein the upper yoke is a U-shaped piece defining and internal rectangular channel into which the side stringer fits; and the upper yoke is attached to the side stringer with a fastener; and the upper yoke includes a slot around the fastener that allows the side stringer to be removed from the upper yoke without fully removing the fastener.

* * * * *